US011699454B1

(12) United States Patent
D Souza et al.

(10) Patent No.: US 11,699,454 B1
(45) Date of Patent: Jul. 11, 2023

(54) DYNAMIC ADJUSTMENT OF AUDIO DETECTED BY A MICROPHONE ARRAY

(71) Applicant: Amazon Technologies, Inc., Seattle, WA (US)

(72) Inventors: Henry Michael D Souza, San Diego, CA (US); Vladimir Adam, San Jose, CA (US); Ragini Rajendra Prasad, Los Altos, CA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 17/379,372

(22) Filed: Jul. 19, 2021

(51) Int. Cl.

| | |
|---|---|
| ***G10L 21/0232*** | (2013.01) |
| ***H04R 3/04*** | (2006.01) |
| ***G10L 21/0264*** | (2013.01) |
| *G10L 21/0216* | (2013.01) |

(52) U.S. Cl.
CPC ..... *G10L 21/0232* (2013.01); *G10L 21/0264* (2013.01); *H04R 3/04* (2013.01); *G10L 2021/02166* (2013.01)

(58) Field of Classification Search
CPC ..... G10L 21/0232; G10L 21/0264; G10L 2021/02166; H04R 3/04
USPC ..... 381/71.1
See application file for complete search history.

(56) References Cited

U.S. PATENT DOCUMENTS

| | | | | |
|---|---|---|---|---|
| 9,363,598 | B1 | 6/2016 | Yang | |
| 9,430,931 | B1 | 8/2016 | Liu et al. | |
| 2015/0222988 | A1* | 8/2015 | Sorensen | H04R 3/002 381/94.1 |

FOREIGN PATENT DOCUMENTS

WO WO-2005036530 A1 * 4/2005 ..... G10L 21/0208

OTHER PUBLICATIONS

Zhang et al., "SIR Beam Selector for Amazon Echo Devices Audio Front-End," IEEE International Workshop on Signal Processing Systems (SiPS), Oct. 2019, 5 pages. Available Online at: https://www.amazon.science/publications/sir-beam-selector-for-amazon-echo-devices-audio-front-end.

* cited by examiner

*Primary Examiner* — Jason R Kurr
*Assistant Examiner* — Friedrich Fahnert
(74) *Attorney, Agent, or Firm* — Kilpatrick Townsend & Stockton LLP

(57) ABSTRACT

Techniques for dynamically adjusting received audio are described. In an example, a computer system receives audio data representing noise and utterance received by a device during a first time interval that has a start and an end. The start corresponds to a beginning of the utterance. The end corresponds to at a selection by the device of an audio beam associated with a direction towards an utterance source. The computer system determines a value associated with an audio adjustment factor. The audio adjustment factor is represented by values that vary during the time interval. The value is one of the values associated with a time point of the first time interval. The computer system generates, based at least in part on the audio data and the value, first data that indicates a measurement of at least one of the noise or the utterance.

20 Claims, 15 Drawing Sheets

DYNAMIC ADJUSTMENT OF AUDIO DETECTED BY A MICROPHONE ARRAY

BACKGROUND

Different modalities are available to control devices. An example modality is visual and relies on graphical user interfaces. Another example modality is vocal and relies on a voice user interface. Voice-based modality can employ what is referred to as near-field voice recognition, in which a user speaks into a microphone located on a hand held device, such as a mobile device. Other voice-based modality systems employ far-field voice recognition, in which a user can speak to a device while the user is within the general vicinity of the device, e.g., within the same room, but not necessarily in close proximity to or even facing the device. Systems can support audio and video functionalities.

DETAILED DESCRIPTION

Figure 1:
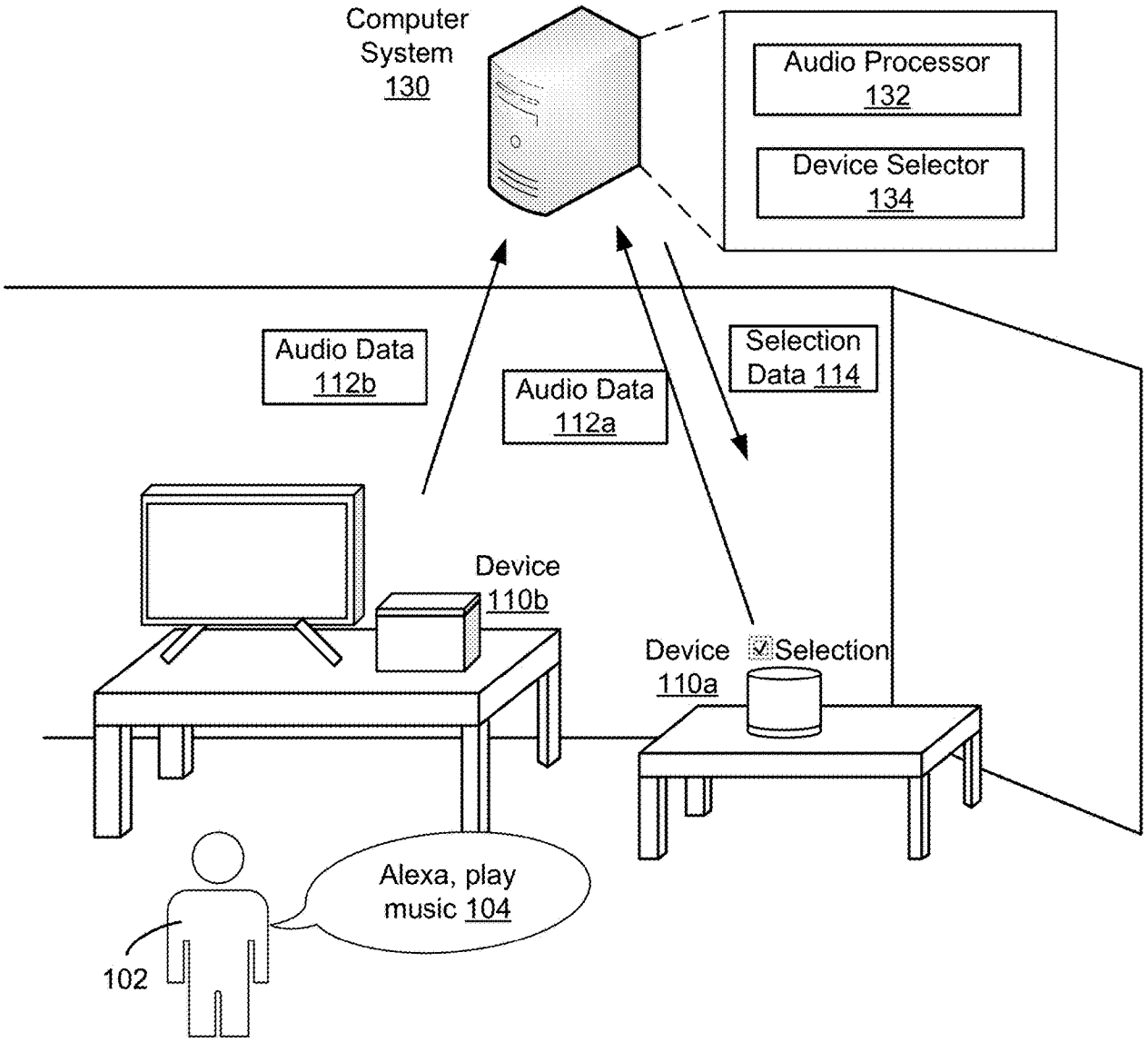
FIG. 1 illustrates an example of multiple devices receiving audio data, according to embodiments of the present disclosure.

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

Embodiments of the present disclosure are directed to, among other things, dynamic adjustment of audio. In an example, a computer system determines audio data associated with a device. The audio data can include a first portion and a second portion, where the first portion represents noise audio detected by the device during a first time interval, and where the second portion represents a superimposition of noise audio and utterance audio detected by the device during a second time interface. The first time interval ends prior to a start of an utterance detection by the device. The second time interval begins at the start of the utterance detection and has a length that includes the time needed for a beamformer of a device to select an audio beam associated with a direction of an utterance source. The computer system determines a value of an audio adjustment factor, where this factor varies during the second time interval to account for the audio detection prior to the selection of the audio beam. The audio adjustment factor can be a noise attenuation factor for attenuating noise audio detected in the second portion, and/or an utterance compensation factor for enhancing utterance audio detected in the second portion. The computer system generates a measurement of the noise audio and/or the utterance audio based on the second portion and the audio adjustment factor.

To illustrate, consider an example of a smart speaker that is located in a room and that a user can speak to by using a wakeword (e.g., "Alexa" or any other wake word). For example, the user may say "Alexa, play music" to trigger a response (e.g., "Your music is playing here," followed by a music output). The smart speaker includes a microphone array and an audio front end that implements a beamformer and a beam selector. A fan is also located in the room, is turned on, and corresponds to a noise source. prior to an utterance of the user, the microphone array detects noise generated by the noise source. The audio front end selects an audio beam having a direction towards the noise source. Subsequently, the smart speaker detects the start of the user utterance, which includes a wakeword. For about 300 milliseconds, the audio front end processes the detected audio data and to then select an audio beam having a direction towards the utterance source (e.g., the user). The smart speaker also generates and sends audio data to a computer system (e.g., a speech processing or other audio processing system). A first portion of the audio data corresponds to 0.5 seconds of audio prior to the start of the user utterance and a second portion that is about 0.75 seconds long. The first 300 milliseconds of the second portion corresponds to the time before the device selected the audio beam directed towards the utterance source. The computer system receives and processes the audio data. This audio processing can include generating a noise spectral measurement from the first portion that indicates an average noise signal level of the first portion and an audio spectral measurement from the second portion that indicates an audio signal level of the superimposed noise audio and utterance audio. The computer system determines a noise attenuation factor that linearly increases during the first 300 milliseconds of the second portion and remains constant afterwards. In addition, the computer system determines an utterance compensation factor that linearly decreases during the first 300 milliseconds of the second portion and remains constant afterwards.

To determine the utterance signal level in the second portion, the computer system attenuates the noise signal level of the noise audio in the second portion by multiplying the noise spectral measurement with the noise attenuation factor to generate an attenuated noise spectral measurement. The computer system also enhances the utterance signal level by subtracting the attenuated noise spectral measurement from the audio spectral measurement and multiplying the result of the subtraction by the utterance compensation factor. The utterance signal level of the second portion (e.g., the wakeword portion) can be used by the computer system to select the smart speaker as a device for which additional audio data can be processed (e.g., in situations where multiple candidate devices are present in the room).

Embodiments of the present disclosure provide various technological advantages. For example, by variably attenuating the noise audio and/or enhancing utterance audio during the time needed to select an audio beam directed to an utterance source, a more accurate estimation of the detected noise audio and of the detected utterance audio detected becomes possible. In turn, more accurate audio processing of the utterance audio becomes possible.

FIG. 1 illustrates an example of multiple devices receiving audio data, according to embodiments of the present disclosure. As illustrated, a user 102 provides an utterance 104 that is received by each of devices 110*a-b*. For example, the utterance 104 can be "Alexa, play music" and may be provided in a vicinity where the microphones of the devices 110*a-b* can detect the utterance 104. Each of the devices 110*a-b* generates audio data 112*a-b*, respectively, based on an audio sampling of at least a portion of the utterance 104. For example, the devices 110*a-b* can generate audio data 112*a-b* for a portion of the utterance 104 that corresponds to a wakeword (e.g., "Alexa") and a remaining portion of the utterance 104 (e.g., "play music"). The audio data 112*a-b* can additionally include a portion of audio sampled prior to the utterance 104, where this portion is included in the audio data 112*a-b* upon each device 110*a-b* detecting the wakeword. This portion of audio may represent noise audio present in the vicinity of the devices 110*a-b*. A computer system 130 can receive the audio data 112*a-b* and based on at least the noise portion and the wakeword portion in each audio data 112*a-b* select one of the devices 110*a-b* for which further audio processing can be performed. FIG. 1 illustrates the computer system selecting the device 110*a*, whereby this device 110*a* can, based on the selection, detect and send additional audio data to the computer system 130 for further processing.

A device can represent an end user device that supports one or more input/output modalities (e.g., including graphical user interfaces and voice-based interfaces) and that can communicate with a computer system 130. For example, the device can be a smart speaker, a voice-controlled device, a smartwatch, smartphone, a tablet, a laptop, a desktop, a smart appliance, an Internet of Things (IoT) device, or any other suitable end user device. In FIG. 1, device 110*a* is illustrated as a smart speaker and device 110*b* is illustrated as a voice-controlled streaming device for controlling and streaming audio and video to a television.

Figure 12:
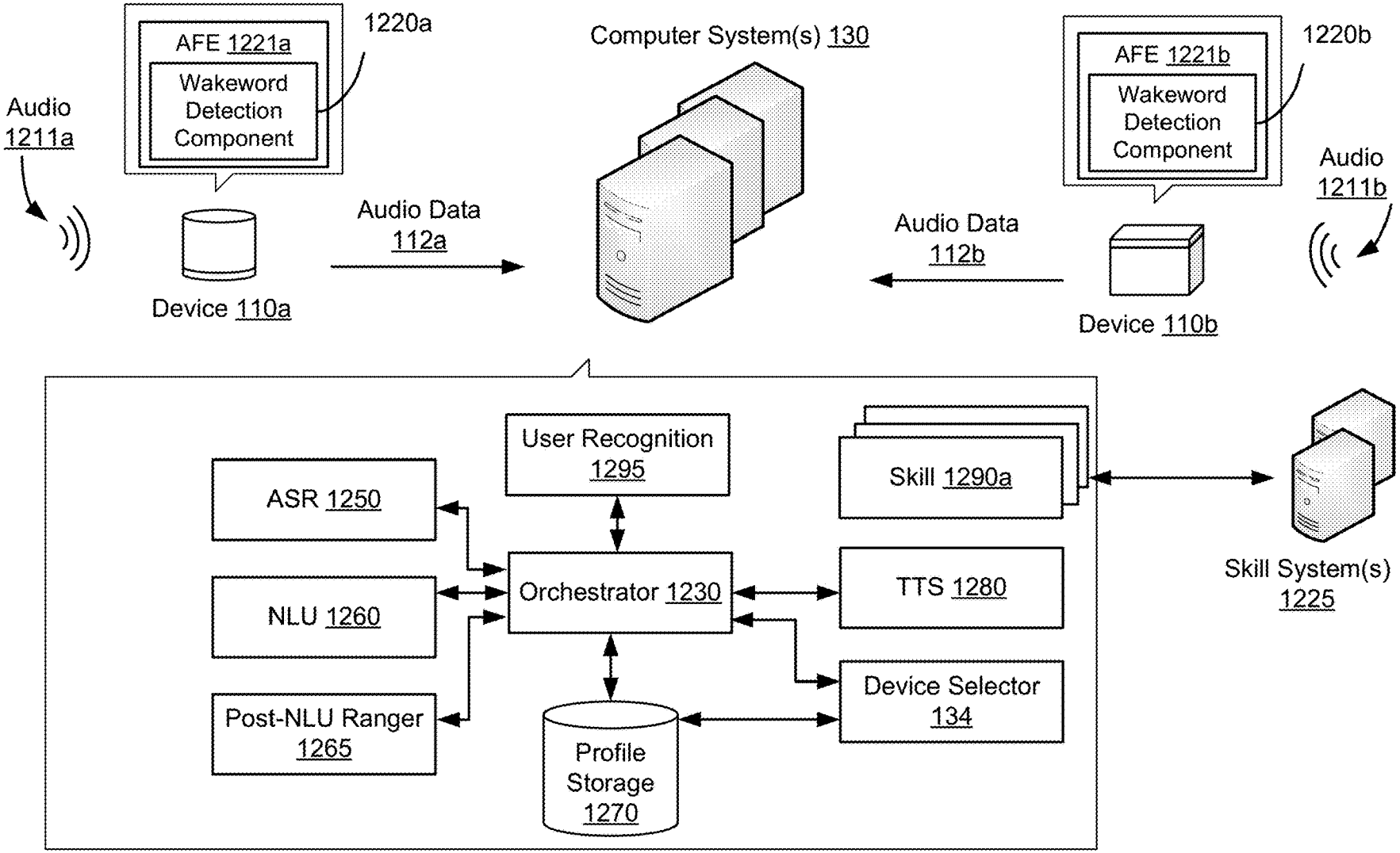
FIG. 12 is a conceptual diagram of components of a system according to embodiments of the present disclosure.

In an example, the computer system 130 receives the audio data 112*a-b* generated by the devices 110*a-b*. The computer system 130 can include hardware and software suitable for communicating with devices and computing services (e.g., third party services). For instance, the computer system 130 can be implemented as a set of servers or a set of resources on servers (e.g., in a datacenter and/or as a cloud-based service). For instance, the computer system 130 can be implemented as a speech processing system. FIG. 12 illustrates detailed components of such a system. As illustrated in FIG. 1, the computer system 130 implements an audio processor 132 that performs measurements to process the audio data 112*a-b*. For example, the audio processor 132 may determine a measurement of an audio signal level of each audio data 112*a-b* over a range of frequencies (e.g., in the range of 20 Hz to 8,000 Hz). In addition, the computer system 130 implements a device selector 134 that executes logic controlling which of the devices 110*a-b* is to be selected based on the utterance 104. Upon a selection of a device, additional audio data received from the device can be further processed by the computer system. In a way, the selected device becomes the input device for the additional audio data. Based on the measurement of the audio signal level corresponding to a wakeword in each of the audio data 112*a-b*, the device selector 134 can determine which of the devices 110*a-b* the utterance 104 was more likely directed towards and can select this device to receive.

As illustrated, the computer system 130 implements the audio processor 132 and the device selector 134 to generate the selection data 114. In an example, the selection data 114 can indicate the device that was selected. In another example, the selection data 114 can alternatively or additionally indicate the device(s) that was(were) not selected.

The computer system 130 can send the selection data 114 to the selected device (e.g., device 110*a* in FIG. 1). The selection data 114 can cause the selected device to act as an input device for additional audio data. Additionally or alternatively, the selection data 114 can be sent to an unselected device (e.g., device 110*b* in FIG. 1), which can cause the unselected device to stop acting as an input device for additional audio data. In an example, the selection data 114 indicates to a device whether the device was selected or not. A directive (e.g., a set of instructions) may also be sent from the computer system 130 to the device to act as an input device or stop acting as the input device as applicable.

Acting as an input device can include detecting audio by a microphone of the input device, generating audio data corresponding to the detected audio, and sending the audio data from the input device to the computer system 130. Stopping acting as an input device can include powering off the microphone, muting the microphone, not generating the audio data, and/or not sending the audio data by the device, or if the audio data is sent, the computer system 130 not performing any of the following: processing the audio data, performing automatic speech recognition to generate text from the audio data, performing natural language understanding of the text, triggering an executable action based on the natural language understanding, and/or any other operation that the computer system 130 can perform based on the audio data when the device is acting as an input device.

Although FIG. 1 illustrates two devices, the embodiments of the present disclosure are not limited as such. For example, more than two devices can be located in proximity of each other (e.g., within a same space). The computer system 130 performs audio processing and device selection of one of these devices. In yet another example, a single device can be located in a space or can detect the user utterance 104. In this case, the device selection may be optionally performed.

Generally, noise audio can be white noise (or any other type of noise) generated from a noise source other than an utterance source or can be, more generally, audio that does not include utterance audio. In comparison, utterance audio can be audio generated by an utterance source. FIG. 1 illustrates a user as an utterance source, although non-user utterances are possible. For example, the utterance source can be a pet, a door bell, a window glass, a smoke alarm, or any other utterance source, where the pet's utterance can be an animal sound, the door bell's utterance can be a ring, the window glass' utterance can be a glass shattering sound, the smoke alarm's utterance can be a smoke alert, etc.). An utterance can be detected and processed to provide different type of services. For instance, a user utterance (e.g., speech of a human) can be processed to provide a content streaming service to the user, or any other service that is indicated as a requested service in the utterance. In comparison, a smoke alarm utterance can be processed to provide a home safety service.

Figure 2:
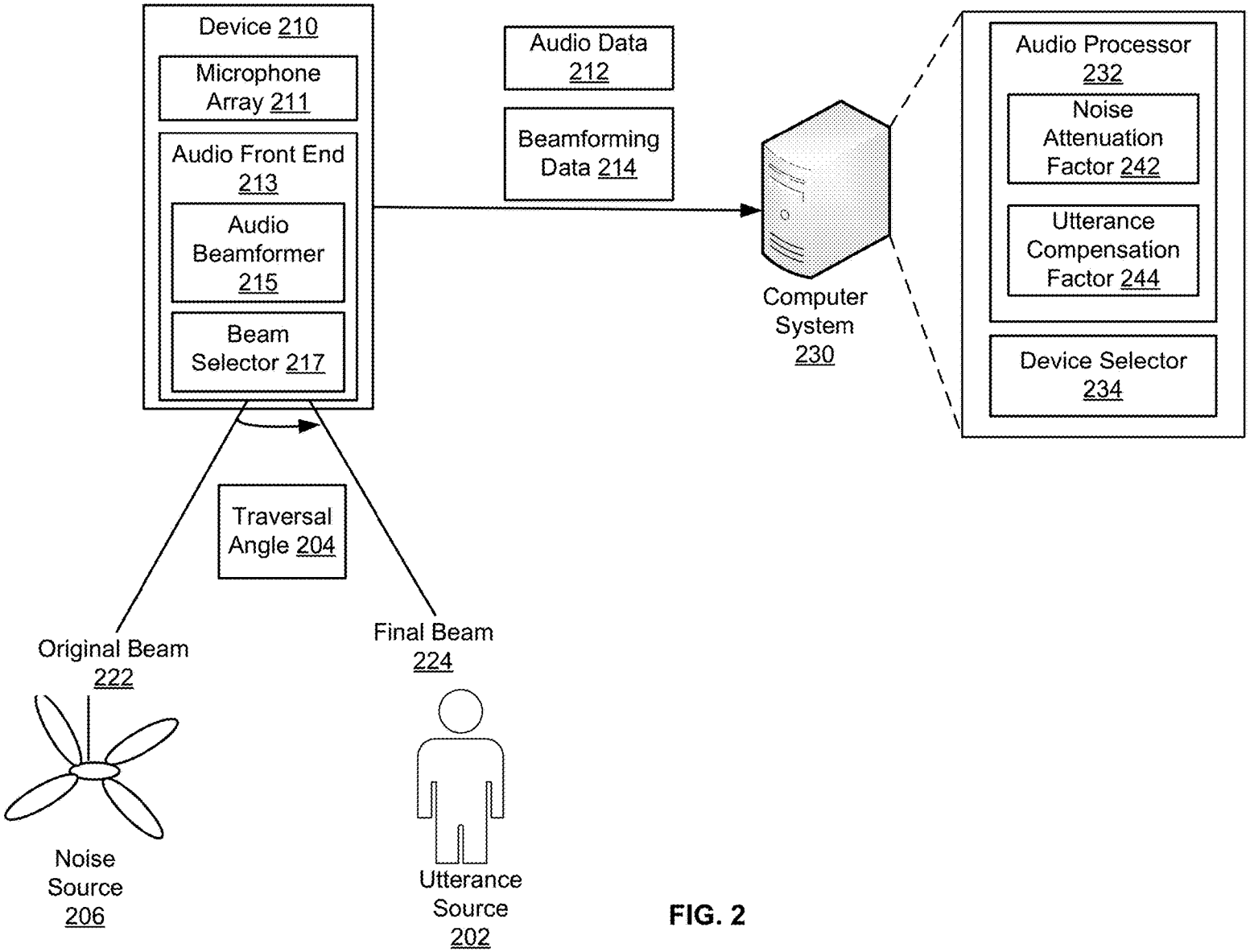
FIG. 2 illustrates an example of scaling audio data generated by a device, according to embodiments of the present disclosure.

FIG. 2 illustrates an example of scaling audio data generated by a device 210, according to embodiments of the present disclosure. The scaling can be performed by a computer system 230 that receives the audio data from the device 210. The computer system 210 can be an example of the computer system 130 in FIG. 1.

In an example, the device 210 includes a microphone array 211 that detects audio and generates audio signals that represent the audio. The device also includes an audio front end 213 that receives and processes the audio signals to generate audio data 212 that represents the audio. In particular, the audio front end 213 includes an audio beamformer 215 and a beam selector 217. The audio beamformer 215 enhances an audio signal from a direction while suppressing audio signals from other directions to generate an enhanced audio signal per direction, which can be referred as a beam or, equivalently, an audio beam. In turn, the beam selector 217 selects a beam (e.g., one of the enhanced audio signals). The audio front 213 can generate the audio data 212 that represents this beam.

The microphone array 211 can include a plurality of microphones that are spaced from each other in a known or predetermined configuration. For instance, the microphone array 211 may be a two-dimensional array, wherein the microphones are positioned within a single plane. In another illustration, the microphone array 211 may be a three-dimensional array, in which the microphones are positioned in multiple planes. The number of microphones can depend on the type of the device 210. Generally, accuracy and resolution of audio beamforming may be improved by using higher numbers of microphones.

The audio beamformer 215 may use signal processing techniques to combine signals from the different microphones of the microphone array 211 so that audio signals originating from a particular direction are enhanced while audio signals from other directions are deemphasized. For instance, the audio signal signals from the different microphones are phase-shifted by different amounts so that audio signals from a particular direction interfere constructively, while audio signals from other directions experience interfere destructively. The phase shifting parameters used in beamforming may be varied to dynamically select different directions. Additionally or alternatively, differences in audio arrival times at different microphones of the microphone array 211 can be used. Differences in arrival times of audio at the different microphones are determined and then analyzed based on the known propagation speed of sound to determine a point from which the sound originated. This process involves first determining differences in arrivals times using signal correlation techniques between the audio signals of the different microphones, and then using the time-of-arrival differences as the basis for sound localization.

The beam selector 217 can receive the enhanced audio signals (e.g., the beams) and can perform measurements on such signals. The measurements can use a reference audio signal, such as an audio signal of one of the microphones of the microphone array 211, or multiple reference audio signals, such as the audio signal of each microphone of the microphone array 211. The measurement on an enhanced audio signal can include determining a property of this signal, such as the signal-to-noise (SNR) ratio or signal-to-interference (SIR) ratio. Generally, the beam selector 217 selects the enhanced audio signal that has the best measurement (e.g., the largest SNR or the largest SIR).

The audio processing of the audio front end 213, including the audio beamformer 215 and the beam selector 217 can be performed in the analog domain and/or the digital domain. some of the operations further include noise cancelation, signal filtering, and other audio processing techniques. Further, and as described herein below with respect to a traversal angle and a beamforming time, the audio front end 213 can generate beamforming data 214 that indicates the traversal angle and/or beamforming time.

In the illustrative example of FIG. 2, a noise source 206 is present in proximity of the device 210. Proximity refers to the device 210 being capable of detecting noise audio generated by the noise source 206. Prior to any utterance audio, the noise audio is the only type of audio that is being detected by the device 210. In this case, the audio front end 213 may select a beam having a direction towards the noise source 206. This beam is shown in FIG. 2 as an original beam 222 and corresponds to an enhanced audio signal that is determined from the audio signals generated by the microphones of the microphone array 211 and that is associated with the direction towards the noise source 206.

Subsequently, the device 210 detects utterance audio from an utterance source 202. Generally, the utterance audio is louder than the noise audio. The utterance detection can occur while also noise audio of the noise source 206 continues to be detected by the device 210. As such, the device 210 can detect superimposed noise audio and utterance audio, which may be referred to herein as audio for brevity. The audio front end 213 can process the audio signals of the microphone array 211 that represent this audio to then select a beam having a direction towards the utterance source. This beam is shown in FIG. 2 as a final beam 224 and corresponds to an enhanced audio signal that is determined from the audio signals generated by the microphones and that is associated with the direction towards the utterance source 202.

The above illustrated beam change can be associated with different parameters. A first parameter relates to the angle difference between the direction of the original beam 222 towards the noise source 206 and the direction of the final beam 224 towards the utterance source 202. This angle difference is illustrated in FIG. 2 as a traversal angle 204. The traversal angle 204 can depend on a number of factors, such as the actual locations of the noise source 206 and the utterance source 202 in the physical space and the beamforming sensitivity of the device 210, which can be a function of the number and spatial distribution of microphones in the microphone array 211. A second parameter relates to the processing time that it takes the audio front end 213 to process the audio signals and selects the final beam 224. This processing time can be referred to herein also as beamforming time. The beamforming time can also depend on a number of factors, such as the processing capability and the implemented beamforming techniques of the device 210 and the audio response characteristic of the physical space where the device 210 is located (which can impact how the audio propagates and is detected by the microphone array 211). In an example, the beamforming time can be in the range of a few milliseconds to hundreds of milliseconds, such as being between 20 milliseconds to 500 milliseconds.

In an example, the audio data 212 generated by the device 210 is received by the computer system 230. The audio data 212 includes noise audio detected in a time interval prior to the utterance and noise and utterance audio detected in a subsequent time interval that corresponds to the utterance. The computer system 230 may additionally receive the beamforming data 214 indicating the traversal angle 204 and/or the beamforming time.

Alternatively, the beamforming data 214 may not be generated or sent to the computer system 230. In this case, the computer system 230 may use predefined values for the traversal angle 204 and the beamforming time (e.g., 45 degrees and 300 milliseconds, depending on the device's 210 type or model).

The computer system 230 processes the audio data 212, and optionally the beamforming data 214, with an audio processor 232. The audio processor 232 determines a spectral measurement of the noise audio in the audio data 212, as further described in FIG. 6. Briefly, the audio data 212 can be generated at a particular sampling rate (e.g., 16 KHz) using audio sampling techniques. Audio samples can be grouped in audio frames (e.g., each audio frame being 10 milliseconds long and including one hundred sixty audio samples). A Fast Fourier Transform (FFT) operation can be performed for each audio frame, where this operation is applied to the audio samples associated with the audio frame and, optionally, audio samples of one or more other audio frames. The FFT operation generates, for each audio frame, outputs across multiple frequencies. A compression operation can be performed for each audio frame, where this compression operation uses frequency bands of certain width (e.g., 250 Hz). Outputs having frequencies within a frequency band can be summed together resulting in a spectral vector per audio frame, where the number of elements of this spectral vector corresponds to the frequency bands. The spectral vectors of the audio frames that correspond to audio detected prior to the utterance detection (e.g., of the first fifty frames) can be averaged to represent an average noise spectral measurement. A spectral vector of a subsequent audio frame represents an audio spectral measurement at that frame. The average noise spectral measurement can be subtracted from this audio spectral measurement to determine the utterance spectral measurement at that frame. As part of this utterance estimation, the noise spectral measurement can be scaled down and the utterance spectral measurement can be scaled up. The scaling down and scaling up can use variable values to account for the redirection of the microphone's 211 beam.

In an example, the audio processor 232 can scale down the noise spectral measurement during the subsequent time interval (e.g., audio frames "50" to "80" corresponding to the redirection of the microphone's 211 beam). The audio processor 232 can determine a noise attenuation factor 242 that varies during the subsequent time interval. This factor is used to attenuate the noise audio such that a better estimation of the utterance audio can be performed. The noise attenuation factor 242 can vary linearly between a first start value associated with a start of the subsequent time interval (e.g., frame "51") and a first end value associated with an end of the subsequent time interval (e.g., frame "80"). The value of the noise attenuation factor 242 can be pre-stored in a data store accessible to the computer system 230, can be different for each frame of the audio data 212, and can indexed using the indexes of the frames. Alternatively, no pre-stored value is used. Instead, the audio processor 232 may use the beamforming data 214 to determine a value of the noise attenuation factor 242 for each frame depending on the size of the traversal angle 204 and/or the length of the beamforming time. In some examples, the noise attenuation factor 242 includes a vector of values. The attenuated measurement is generated by multiplying the average noise spectral vector by the second vector with varying values depending on the audio frame. During a third time interval subsequent to the subsequent time interval (e.g., frames eighty-one and on) the noise attenuation factor 242 can have a constant value.

The audio processor 232 can also scale up the utterance spectral measurement during the subsequent time interval. To do so, the audio processor 232 determines an utterance compensation factor 244 that varies during the subsequent time period. The utterance compensation factor 244 can vary linearly between a second start value associated with the start of the subsequent time interval and a second end value associated with the end of the subsequent time interval. The value of the utterance compensation factor 244 can be pre-stored and different for each frame of the audio data 212. Alternatively, the audio processor 232 may use the beamforming data 214 to determine a value of the utterance compensation factor 244 for each frame. During the third time interval subsequent to the subsequent time interval, the utterance compensation factor 244 can have a constant value. The audio processor 232 can apply the utterance compensation factor 244 to the noise and utterance audio based on a timing of the noise and utterance audio to scale up the utterance audio.

The utterance spectral measurement for each audio frame that corresponds to the wakeword (e.g., audio frames "51" to "125") or the average utterance spectral measurement of these audio frames can be input to a device selector 234 of the computer system 230. The device selection 234 may receive similar input measurement(s) associated with another device(s). The device selector 234 select, based on such, a device to select as an input device of additional audio data. For example, when its average utterance spectral measurement is the largest, the device 210 is more likely to be selected.

Although FIG. 2 illustrates a situation where a noise source is in proximity of the device 210 and the devices 210 has selected a beam associated with a direction towards the noise source prior to detecting an utterance, embodiments of the present disclosure are not limited as such. For instance, no noise source may be in proximity of the device 210 prior to the utterance detection. In this case no beam may be selected prior to the utterance detection and any detected noise audio represents white noise present in the environment around the device 210. Upon detection of the utterance, the device 210 can select the beam associated with a direction towards an utterance source. In this case, the traversal angle can be an angle difference between a reference direction and the direction towards the utterance source 210. The reference direction can be a default direction or the direction associated with the last selected beam. The beamforming time corresponds to the processing time for selecting the beam associated with the direction towards the utterance source.

Figure 3:
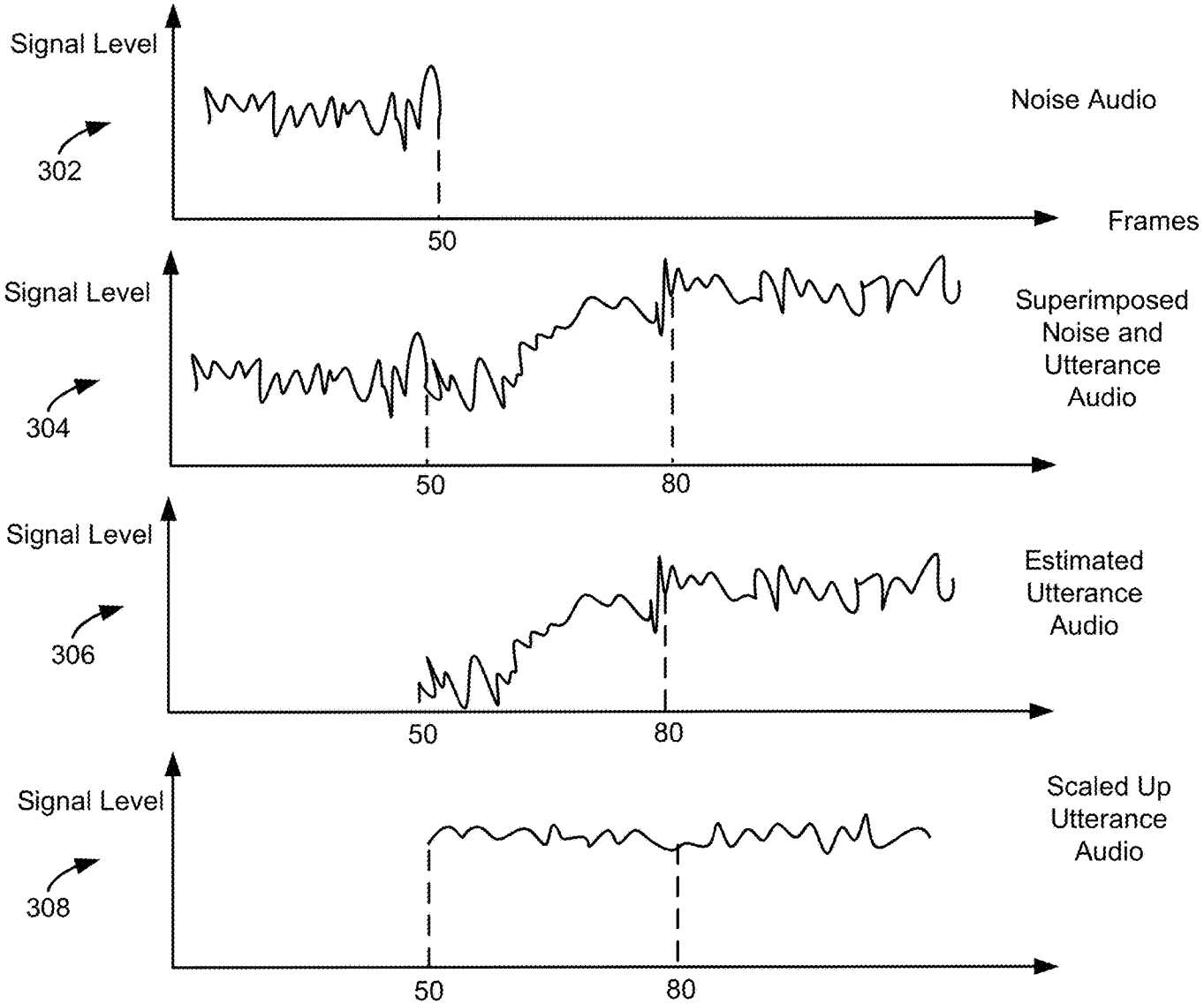
FIG. 3 illustrates examples of graphs of spectral measurements throughout a dynamic audio scaling process, according to embodiments of the present disclosure.

FIG. 3 illustrates examples of graphs of spectral measurements throughout a dynamic audio scaling process, according to embodiments of the present disclosure. Each graph shows a signal level over a number of frames. The signal level can be indicated by a spectral measurement as described herein above. The illustrated value at each frame corresponds to a magnitude of the corresponding spectral vector.

A first graph 302 corresponds to a first time interval during which only noise is detected by a device (e., the device 210 of FIG. 2). The first time interval is illustrated as being fifty frames long. Only noise audio is present during the first time interval since an utterance has not been detected yet.

In a second graph 304, superimposed noise and utterance audio is detected by the device during a second time period subsequent to the first time period. This second time period is illustrated as being thirty frames long, from frames "51" to "80" and corresponds to a beamforming time needed by the device to select a beam associated with a direction towards an utterance source that generated the utterance.

In a third graph 306, the signal level of estimated utterance audio is shown. The noise signal level (or an average of the noise signal level over frames "1" to "50") of the first graph 302 can be subtracted from the noise and utterance audio signal level of the second graph 304 to generate the estimated utterance signal level.

In a fourth graph 308, a scaled utterance signal level is shown. The scaled utterance signal level is scaled based on an utterance compensation factor and/or a noise attenuation factor for each frame. These factors may vary over the frames during the second time period (e.g., linearly vary between frames "51" and "80"). For audio frames occurring subsequently to the beam selection (e.g., frame "81" and on), these factors may become constant.

Figure 4:
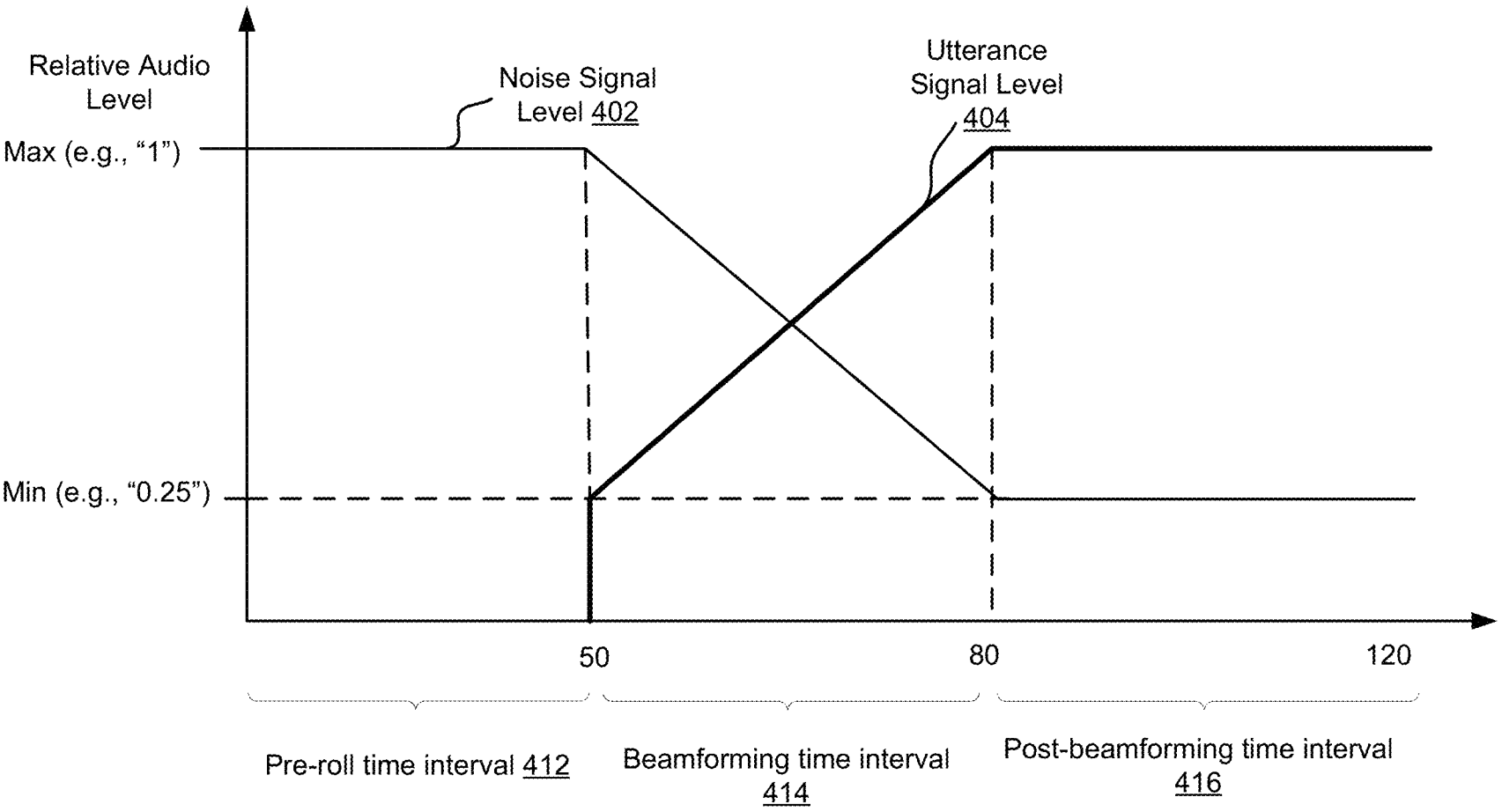
FIG. 4 illustrates an example of relative signal levels for noise audio and utterance audio based on dynamic scaling, according to embodiments of the present disclosure.

FIG. 4 illustrates an example of relative signal levels for noise audio and utterance audio based on dynamic scaling, according to embodiments of the present disclosure. A first relative signal level represents a normalization of this first signal level using the second signal level. A relative utterance signal level 404 represents an estimation of utterance audio generated by subtracting an average noise signal level from a superimposition of noise and utterance audio signal level. A pre-roll time interval 412 is a time interval having a predefined length, during which only noise audio is detected, and ending at the beginning of an utterance detection. Hence, a corresponding relative noise signal level 402 is at a maximum value. In the illustration of FIG. 4, the pre-roll time interval 412 is 0.5 second long. Audio processing is performed using 10 milliseconds frames. As such the pre-roll time interval 412 spans frames "1" to "50."

At the end of the pre-roll time interval 412, the beginning of an utterance is detected. Audio beamforming is performed to select a beam associated with a direction towards the utterance source. This audio processing may span a beamforming time interval 414, which is the time between the beginning of the utterance detection to the beam selection. During this time beamforming time interval 414, audio data is received and may not correspond to the enhanced audio signal of the beam. Instead, the audio data can correspond to a previously selected beam or to a combination of (e.g., an average) of the audio signals generated by the different microphones of the device's microphone array. In both cases, the audio data can represent superimposed noise audio and utterance audio detected during the beamforming time interval 414. The relative noise signal level 402 of the noise component can be scaled down and the relative utterance signal level 404 of the utterance component can be scaled up. Each audio frame during the beamforming time interval 414 can be associated with a noise attenuation factor for scaling down the relative noise signal level 402 and an utterance compensation factor for scaling up the relative utterance signal level 404. The noise attenuation factor and the utterance compensation factor can vary linearly from frame "51" to frame "80" as shown. The maximum value (e.g., "1") and the minimum value (e.g., "0.25") may be predefined and retrievable from a data store. The data store can store an index for each audio frame and the corresponding value to use for the noise attenuation factor and the utterance compensation factor. In the illustration of FIG. 4, the beamforming time interval 414 is 300 millisecond long. Because audio processing is performed using 10 milliseconds frames, beamforming time interval 414 spans frames "51" to "80," such that the dynamic scaling of the noise signal level 402 and the utterance signal level 404 is performed between frames "51" and "80."

Once the beam associated with the direction of the utterance source is selected, audio data corresponding to this beam is received and processed. In the illustration of FIG. 4, this audio data spans a post-beamforming time interval 216 that starts at frame "81". During this post-beamforming time interval 416, the noise attenuation factor and the utterance compensation factor can become constant. The relative utterance signal level 404 can then be at the maximum value, while the relative noise signal level 402 can be at the minimum value.

Figure 5:
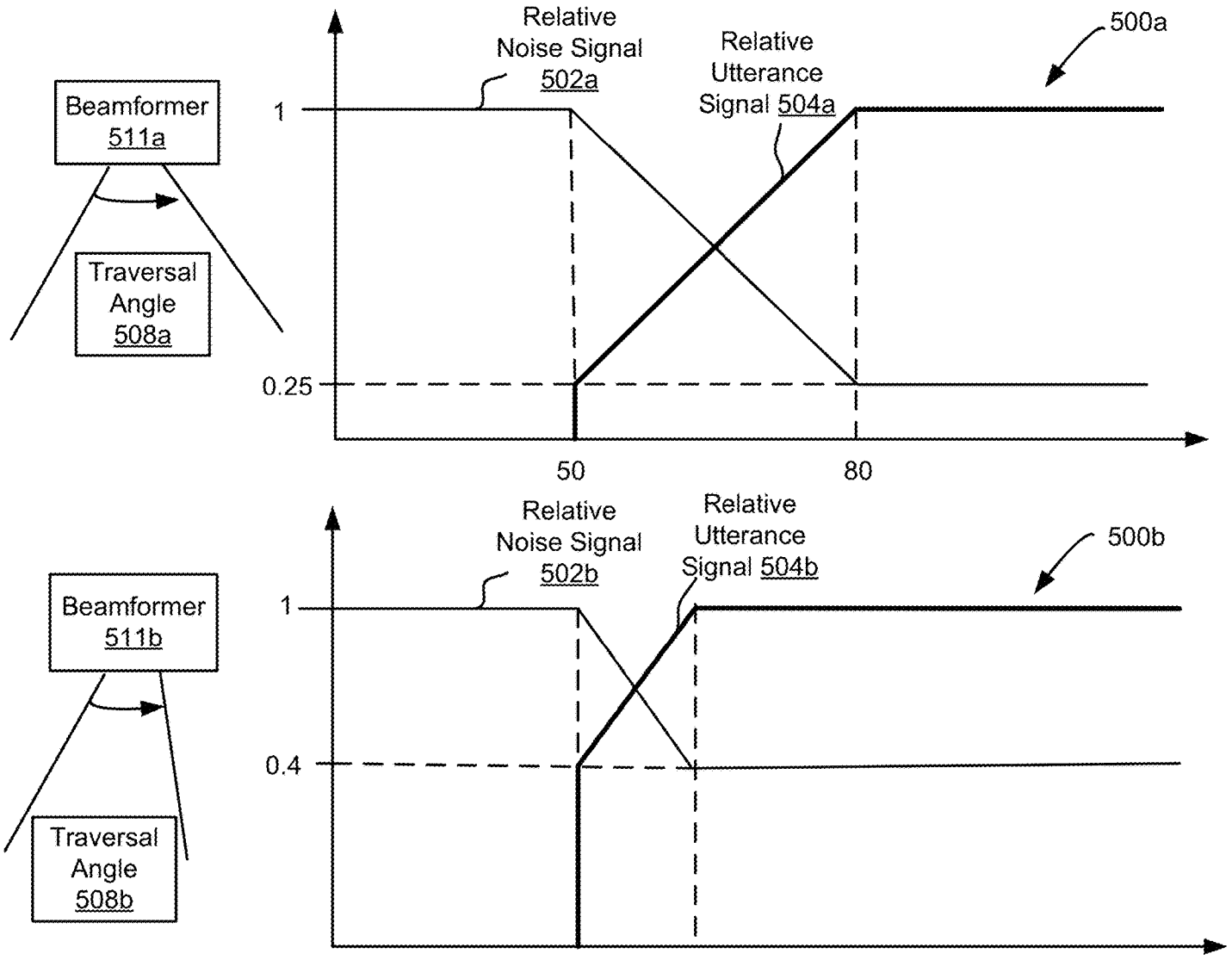
FIG. 5 illustrates another example of relative signal levels for noise audio and utterance audio based on dynamic scaling, according to embodiments of the present disclosure.

FIG. 5 illustrates another example of relative signal levels for noise audio and utterance audio based on dynamic scaling, according to embodiments of the present disclosure. Graph 500*a* corresponds to the graph in FIG. 4, with a beamformer 511*a* selecting a beam associated with a direction towards an utterance source, where this beam selection results in traversal angle 508*a* and is performed within a beamforming time interval. During this interval (shown as 300 milliseconds or thirty frames), the relative noise signal 502*a* and utterance signal 504*a* are linearly adjusted to scale down the relative noise signal level 502*a* and to scale up the relative utterance signal level 504*a*.

Figure 8:
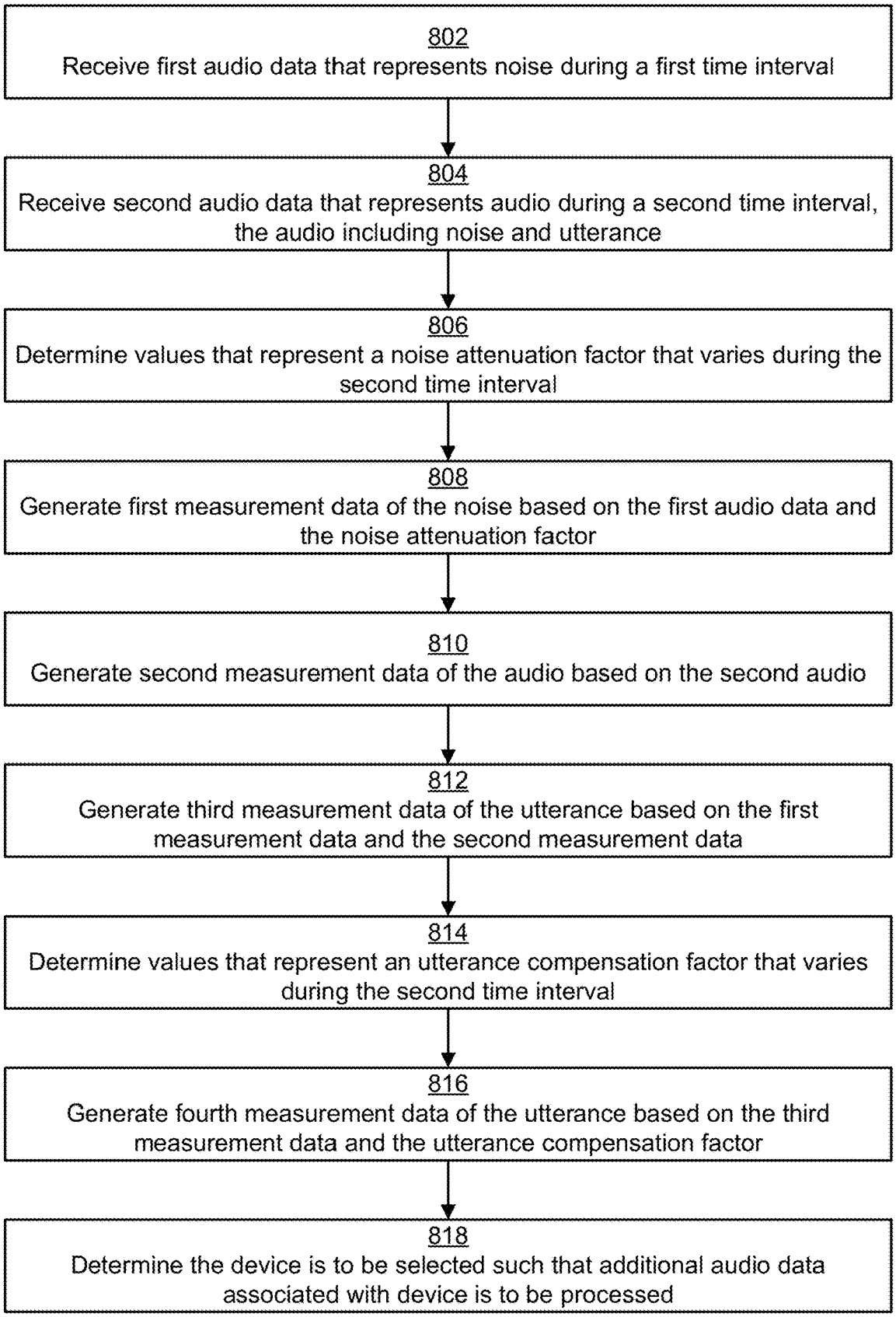
FIG. 8 illustrates an example of a flow for dynamically scaling utterance audio, according to embodiments of the present disclosure.

Graph 500*b* shows a beamformer 511*b* selecting a beam associated with a direction towards an utterance source, where this beam selection results in traversal angle 508*b* and is performed within a beamforming time interval (shown as 100 milliseconds, or ten frames). In the illustration of FIG. 8, the traversal angle 508*b* and the beamforming times are smaller than those of the beamformer 511*a*. Hence, the values of the noise attenuation factor and the utterance compensation factor can be different from what is shown in Graph 500*a*. For example, a relative noise signal level 502*b* of the noise audio can be scaled down between frames "51" and "60" by linearly decreasing the attenuation factor from a value of "1" to the value of "0.4." Conversely, a relative utterance signal level 504*b* can be scaled up between frames "51" and "60" by linearly increasing the utterance compensation factor from a value of "0.4" to a value of "1."

Generally, a start value and/or an end value of the noise attenuation factor and/or the utterance compensation factor can depend on the traversal angle and/or beamforming time. In an example, the start value of the noise attenuation factor and the end value of the compensation factor are set to "1." In comparison, the end value of the noise attenuation factor and the start value of the compensation factor depend on traversal angle and/or beamforming time. These two values can be modeled using, for instance, a curve. A ninety degree angle can correspond to a maximum of the curve indicating that the detected noise audio is at a maximum. Conversely, a zero degree angle can correspond to a minimum of the curve indicating that the detected noise audio is at a minimum. Other traversal angles can be associated with a curve value between the maximum and the minimum. In this example, depending on the actual traversal angle, the curve is used to look up the end value of the attenuation factor and the start value of the noise compensation factor. For example, if the travel angle is ninety degrees, the end value and start value correspond to the minimum and maximum, respectively, of the curve. Further, the beamforming time can be used to compute a slope for the linear variation between the start and end values of the noise attenuation factor and the start and end values of the utterance compensation factors. The shorter the time, the steeper the slope is. Although a single curve is described in connection with this example, multiple curves can be predefined, each being associated with one of the noise attenuation factor or the utterance compensation factor.

Figure 6:
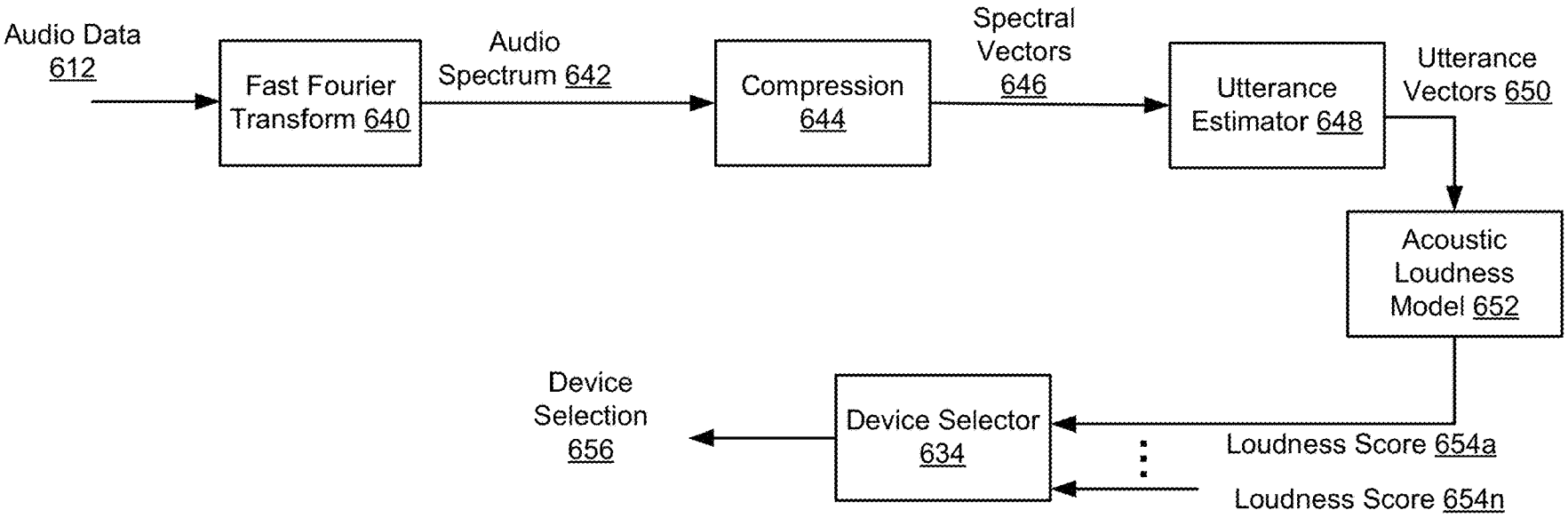
FIG. 6 illustrates a block diagram of an example of audio to determine and use spectral measurements, according to embodiments of the present disclosure.

FIG. 6 illustrates a block diagram of an example of audio to determine and use spectral measurements, according to embodiments of the present disclosure. The process may be performed by components of a computer system, such as the computer system 130 in FIG. 1.

In an example, the computer system receives audio data 612 that corresponds to a portion of an utterance (e.g., a wakeword portion of the utterance, with noise superimposed therewith) detected by a device and to noise detected prior to the utterance. In an example, the device, having proper user permissions and operating in compliance with all user privacy requirements, may receive and digitize an audio signal to generate audio data. This audio data indicates, for example, amplitudes of audio samples of the audio signal according to a sampling rate and a block length. Upon detecting the wakeword in the digitized audio, the device may generate the audio data 612 by including therein the noise portion (e.g., a 0.5 seconds audio portion) that precedes the wakeword detection and the superimposed noise and wakeword portion (e.g., the next 0.75 seconds). In an example, the audio data 410 corresponds to twenty thousand audio samples generated for a 1.25 second time window at a 16 KHz sampling rate. The first eight thousand audio samples correspond to the 0.5 seconds of noise audio, and the remaining twelve thousand audio sample corresponds to the 0.75 seconds of superimposed noise and wakeword audio. Further, the audio processing can involve audio frames, where an audio frame corresponds to a set of the audio samples. For example, each frame can correspond to 10 milliseconds of audio or, equivalently, one hundred sixty audio samples. In this example, 125 audio frames correspond to the 1.25 seconds of audio and the twenty thousand audio samples.

The computer system can perform a Fast Fourier Transform (FFT) 640 on the audio data 612. The FFT 640 can be performed for each frame, by using the one hundred sixty audio samples of that frame and additional samples from preceding frames (e.g., for a total of five hundred twelve audio samples). FFT 640 produces an audio spectrum 642 of two hundred fifty-six data points that indicate a spectral measurement of the audio signal level.

In an example, the computer system performs compression 644 on the audio spectrum 642. The compression 644 relies on frequency bands, each representing a frequency range. For example, the audio spectrum 642 can be compressed into thirty-two bands, each representing a 250 Hz range. The computer system can sum up consecutive frequency FFT outputs in the audio spectrum 642 to generate the thirty-two frequency bands. As an example, the frequency band "0" can correspond to a sum of the first eight FFT outputs of the audio spectrum 642 and represent 0 Hz to 249 Hz, frequency band "1" can correspond to a sum of FFT outputs nine through sixteen of the audio spectrum 642 and represent 250 Hz to 499 Hz, and so on. The computer system generates spectral vectors 646 over the thirty-two frequency bands (e.g., each spectral vector corresponds to a frame and includes thirty-two elements, where the value of each element corresponds to a frequency band and is equal to the sum of the eight FFT outputs generated for the frame and associated with the frequency band). As such, a spectral vector is determined for each frame and includes the summed FFT outputs for each of the thirty-two frequency bands. The first fifty spectral vectors correspond to frames "1" to "50" and represent noise audio. The next seventy-five spectral vectors correspond to frames "51" to "125" and represent superimposed noise and utterance audio.

The computer system then uses an utterance estimator 648 to differentiate noise data from utterance data in the spectral vector 646. The utterance estimator 648 determines a first spectral measurement indicating an average noise signal level from the frames prior to the detection of the wakeword (e.g., for the first 0.5 seconds or, equivalently, prior to the fifty-first frame). For example, the first fifty spectral vectors are averaged to generate an average noise spectral vector. For any subsequent frame that falls after the start of the utterance, the utterance estimator 648 can scale down the average noise spectral vector by determining the value of the noise attenuation factor that is applicable to the frame and multiplying the average noise spectral vector with that value. To estimate the utterance spectral vector at any of these subsequent frames, the utterance estimator 648 subtracts, for that frame, the scaled down average noise spectral vector from the corresponding noise and utterance spectral vector and scales up the result of the subtraction by the applicable value of the utterance compensation factor. The resulting utterance spectral vector of a frame represents the estimated utterance audio at that frame over the thirty-two frequency bands.

In an example, an acoustic loudness model 652 processes the utterance vectors 650 to generate a loudness score 654*a* that is indicative of the utterance being directed at the device. The acoustic loudness model 652 may process the entirety of each utterance vector, or a portion of the utterance vector (e.g., frequency bands two through twenty-six, or high frequency bands larger than frequency band fourteen) to generate the loudness score 654*a*. Different types of acoustic loudness models are possible. The acoustic loudness model 652 may average, per frequency band, the utterance vectors 650 to generate an average utterance spectral vector. The magnitude of this average vector can be divided by a sensitivity of the device's microphone to generate a loudness score 654*a*. In another example, the acoustic loudness model 652 may also involve a characteristic matrix determined based on locations of devices within a space. The characteristic matrix includes inter-device attenuation values representing the attenuation experiences between a pair of devices. Such values are used in the computation of the loudness score 654*a* such that the device's location and the relevant signal attenuation are accounted for. An example of the acoustic loudness model 652 is described in U.S. patent application Ser. No. 16/583,699, which is incorporated hereby reference.

The acoustic loudness model 652 can process utterance vectors for audio data generated by multiple devices for the same utterance. A loudness score can be determined for each utterance vector. For example, if "n" devices generate audio data for an utterance, the acoustic loudness model 652 can produce loudness scores 654*a-n*.

In an example, a device selector 634 of the computer system receives the loudness scores 654*a-n* to select a device as an input device. The device selector 634 may compare the loudness scores 654*a-n* to determine which score is the highest. The device selector 634 can then select a device associated with the highest loudness score to be the input device for additional audio data. A device selection 656 can be generated indicating the selected device.

Figure 7:
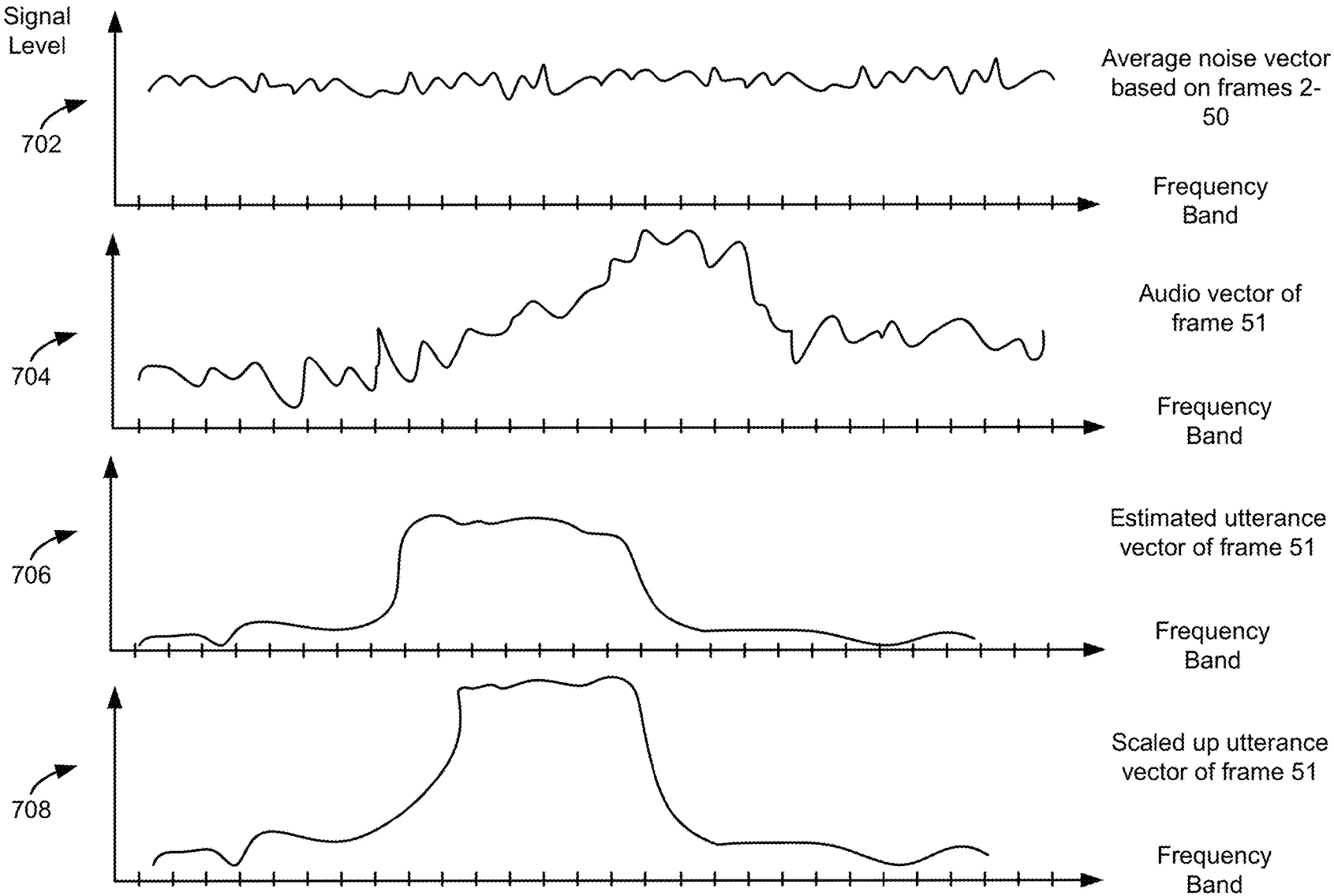
FIG. 7 illustrates examples of graphs of spectral measurements throughout a dynamic audio scaling process, according to embodiments of the present disclosure.

FIG. 7 illustrates examples of graphs of spectral measurements throughout a dynamic audio scaling process, according to embodiments of the present disclosure. A first graph 702 shows an average noise vector based on audio frames "2" through "50." The average noise vector represents a spectral measurement of the average noise signal level (e.g., amplitude) of the audio detected by a device between frames "2" and "60" over frequency bands "1" through "32." These audio frames correspond to a time interval in which only noise data is present in audio data.

A second graph 704 shows an audio vector of frame "51," which corresponds to a time interval in which the audio data includes noise and utterance data. This audio vector represents a spectral measurement of the superimposed noise audio and utterance audio detected by a device for frame "51" over the frequency bands "1" through "32." A third graph 706 shows an estimated utterance vector of frame "51." This utterance vector represents a spectral measurement of the utterance audio estimated for frame "51" over the frequency bands "1" through "32." This estimated utterance vector is determined by scaling down the average noise vector in the first graph 702 and subtracting the scaling down result from the audio vector in the second graph 704. The scaling down uses a value of a noise attenuation factor, where this value is specific to frame "51." A fourth graph 708 shows a scaled up utterance vector of frame "51." This utterance vector represents an adjusted spectral measurement of the utterance audio estimated for frame "51" over the frequency bands "1" through "32." The estimated utterance vector in the third graph 706 can be multiplied by a value of an utterance compensation factor to generate the scaled up utterance vector, where this value is specific to frame "51."

FIGS. 8-11 illustrate examples of flows for aspects of the present disclosure.

Operations of the flows can be performed by a computer system, such as the computer system 130. Some or all of the instructions for performing the operations can be implemented as hardware circuitry and/or stored as computer-readable instructions on a non-transitory computer-readable medium of the computer system. As implemented, the instructions represent modules that include circuitry or code executable by processor(s) of the computer system. The use of such instructions configures the computer system to perform the specific operations described herein. Each circuitry or code in combination with the relevant processor(s) represent a means for performing a respective operation(s). While the operations are illustrated in a particular order, it should be understood that no particular order is necessary and that one or more operations may be omitted, skipped, performed in parallel, and/or reordered.

FIG. 8 illustrates an example of a flow for dynamically scaling utterance audio, according to embodiments of the present disclosure. In an example, the flow includes operation 802, where the computer system receives first audio data that represent noise during a first time interval. For instance, the noise is received by a device that generates and sends the first audio data. In this case, the first audio data is noise data. The first time interval ends before an utterance is detected by the device. In an illustration, the first time interval is a pre-roll time having a predefined length (e.g., 0.5 seconds).

In an example, the flow includes operation 804, where the computer system receives second audio data that represents audio during a second time interval. The audio includes noise and utterance. For instance, the second time interval start when the utterance is detected. The audio is received by the device during the second time interval and represents a superimposition of the noise and portion of the utterance received during the second time interval. The second time interval has a start and an end. The start corresponds to the detection of the utterance starts. The end corresponds to when a beamformer of the device selects an audio beam associated with a direction towards an utterance source. In an illustration, the second time interval can be equal to a beamforming time interval. The length of this time interval can be predefined (e.g., 300 milliseconds) or can be received in beamforming data sent by the device.

In an example, the flow includes operation 806, where the computer system determines values that represent a noise attenuation factor that varies during the second time interval. The computer system can determine the values from a data store, where each value is associated with a time point of the second time interval. In an illustration, each time point can be a time stamp indicating a timing of a portion of the second audio data. In another illustration, the processing of the second audio data includes processing of corresponding audio frames. A time point can be an audio frame index indicating a timing of the audio frame with the sequence of audio frames. The noise attenuation factor can increase (e.g., linearly) from a first minimum value associated with the start of the second time interval to a maximum value associated with the end of the time interval. At each time point, the noise attenuation factor can have a specific value between the first minimum value and the first maximum value.

In an example, the flow includes operation 806, where the computer system generates first measurement data of the noise based on the first audio data and the noise attenuation factor. For instance, the first measurement data indicates a measurement of a signal level, such as an amplitude. FFT operations can be performed on the first audio data, and the computer system can determine a spectral measurement of the noise received during the first time interval, where this spectral measurement indicates an average of the amplitude of the noise. The first measurement data can include attenuated values of the average amplitude, where these attenuated values vary during the second time interval. In particular, for each time point of the second time interval, the computer system multiplies the average amplitude by the value of the noise attenuation factor associated with the time point.

In an example, the flow includes operation 810, where the computer system generates, second measurement data of the audio based on the second audio data. For example, the computer system can perform FFT operations on the second audio to generate spectral measurements of the audio. The spectral measurement can indicate a signal level of the audio, such as the amplitude thereof. The amplitude (or signal level) can have values that vary during the second time interval. These values are associated with the corresponding time points and are indicated in the second measurement data.

In an example, the flow includes operation 812, where the computer system generates third measurement data of the utterance based on the first measurement data and the second measurement data. For example, for each value of the amplitude (or, more generally, signal level) of the audio, the computer system determines the time point associated with this value, in addition to the attenuated value of the noise's average amplitude (or, more generally, noise's signal level) also associated with the time point. The attenuated value is subtracted from the value of the audio to then generate an adjusted value of the audio at the time point. This process can be repeated for the length of the second time interval, resulting in adjusted values of the amplitude (or, more generally, signal level) of the audio. These adjusted values are associated with the time points of the second time interval and are indicated in the third measurement data.

In an example, the flow includes operation 814, where the computer system determines values that represent an utterance compensation factor that varies during the second time interval. The computer system can determine the values from a data store, where each value is associated with a time point of the second time interval. The utterance compensation factor can decrease (e.g., linearly) from a second maximum value associated with the start of the second time interval to a second minimum value associated with the end of the time interval. At each time point, the audio compensation factor can have a specific value between the second maximum value and the second minimum value. In an example, the first maximum value is equal to the second maximum value, the first minimum value is equal to the second minimum value, and the utterance compensation factor is the inverse of the noise attenuation factor.

In an example, the flow includes operation 816, where the computer system generates fourth measurement data of the utterance based on the third measurement data and the utterance compensation factor. For example, for each adjusted value of the amplitude (or, more generally, signal level) of the audio, the computer system determines the time point associated with this value, in addition to the value of the utterance compensation factor also associated with the time point. The adjusted value is multiplied by the value of the compensation factor to then generate a value of an amplitude (or, more generally, a signal level) of the utterance at the time point. This process can be repeated for the length of the second time interval, resulting in values of the amplitude (or, more generally, signal level) of the utterance. These values are associated with the time points of the second time interval and are indicated in the fourth measurement data.

In an example, the flow includes operation 818, where the computer system determines that, between multiple devices, the device is to be selected such that additional audio data associated with the device is to be processed. This selection can be based on the fourth spectral measurement data and measurement data generated for other devices. In an example, the selection is made by using such measurement data as inputs to an acoustic model, where this acoustic model outputs data indicating, per device, a likelihood associated with processing additional audio data generated by the device.

Figure 9:
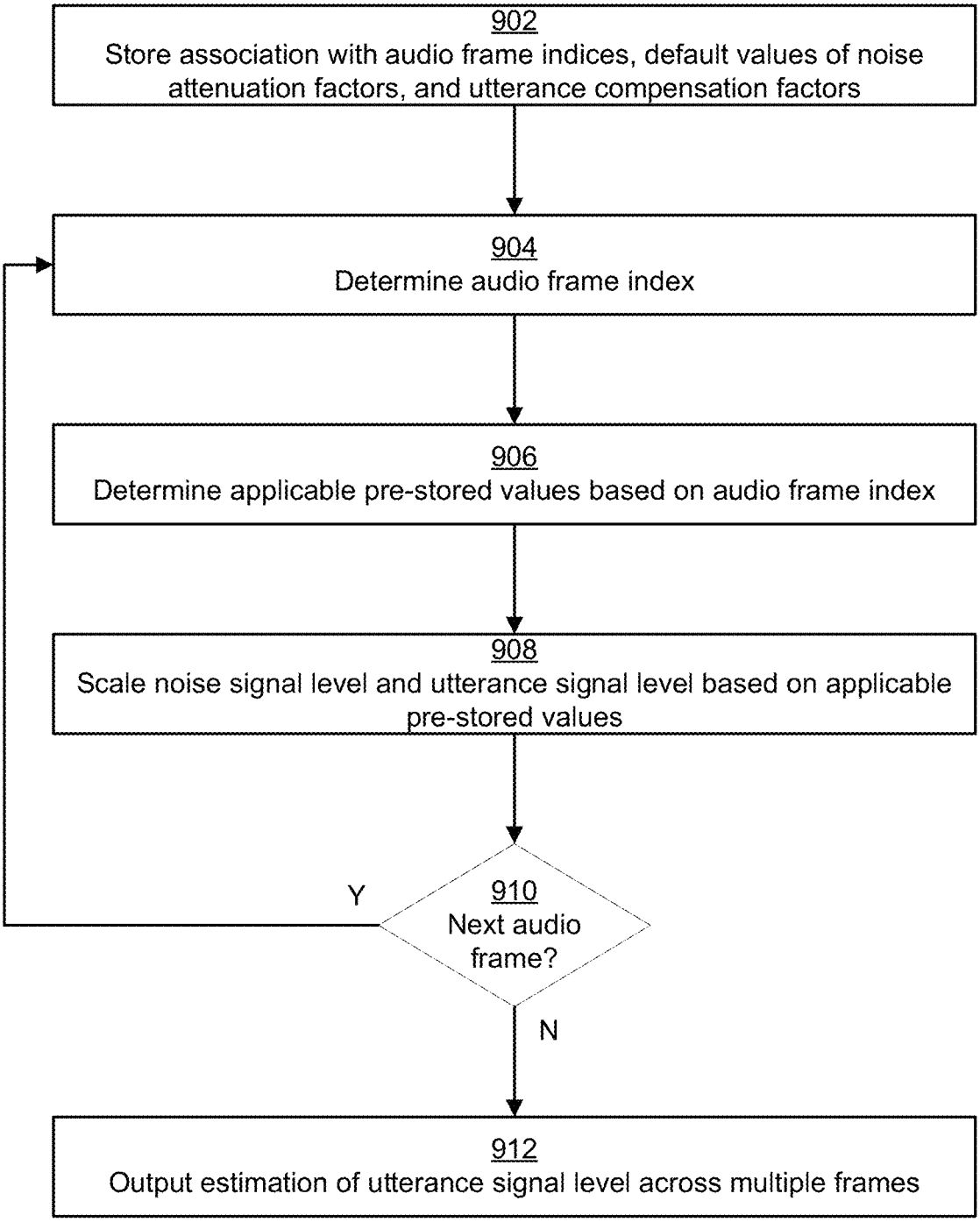
FIG. 9 illustrates an example of a flow for dynamically scaling utterance audio using predefined values for a noise attenuation factor and an utterance compensation factor, according to embodiments of the present disclosure.

FIG. 9 illustrates an example of a flow for dynamically scaling utterance audio using predefined values for a noise attenuation factor and an utterance compensation factor, according to embodiments of the present disclosure. In an example, the flow includes operation 902, where the computer system stores default values of a noise attenuation factor and a utterance compensation factor and their associations with audio frame indices. Such data can be stored in a data store that is accessible by the computer system.

In an example, the flow includes operation 904, where the computer system determines an audio frame index. The audio frame index corresponds to an audio frame of audio data being processed. The index may be based on a timestamp or frame number associated with an audio frame. For example, if the computer system determines the audio frame includes a timestamp of 0.5 seconds, the computer system can determine the audio frame index is for frame "50."

In an example, the flow includes operation 906, where the computer system determines applicable pre-stored values based on the audio frame index. For example, when processing audio frame index "i," the data store is looked up to determine the value of the noise attenuation factor applicable to index "i" and the value of the utterance compensation factor also applicable to index "i." At the start of the utterance detection (e.g., at frame "51"), the noise attenuation factor may be at the minimum value and the utterance compensation factor may be at the maximum value. At the end of the beamforming redirection (e.g., at frame "80"), the noise attenuation factor may be at the maximum value and the utterance compensation factor may be at the minimum value. In between the start and the end, the noise attenuation factor may be linearly increased and the utterance compensation factor may be linearly decreased, where the corresponding values are determined based on the index "i" look-up.

In an example, the flow includes operation 908, where the computer system scales the noise signal level and utterance signal level based on the applicable pre-stored values. For example, when processing audio frame "i," the noise signal level is an average noise spectral vector, whereas the utterance signal level is an estimated utterance spectral vector associated with audio frame "i." The computer system can multiply the noise spectral vector by the value of the noise attenuation factor applicable to index "i" to subtract it from the audio spectral vector and can scale up the result by multiplying with value for the utterance compensation factor also applicable to index "i."

In an example, the flow includes operation 910, where the computer system determines whether there is a next audio frame. If another audio frame exists, the flow returns to operation 904. Otherwise, the flow proceeds to operation 912.

In an example, the flow includes operation 912, where the computer system outputs an estimation of the utterance signal level across multiple frames. For example, the estimation is a set of utterance spectral vectors, each associated with an audio frame index "i."

Figure 10:
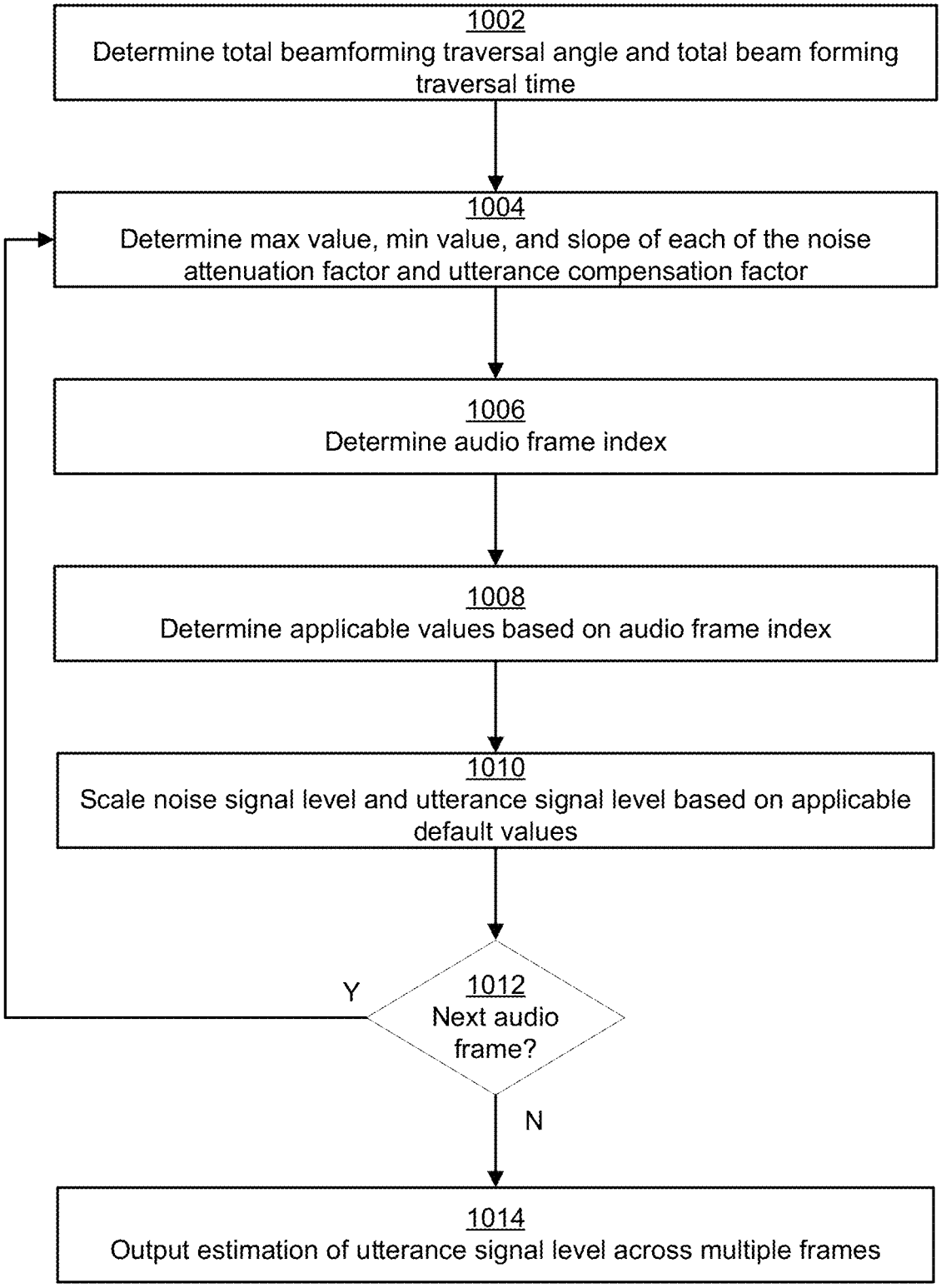
FIG. 10 illustrates an example of a flow for dynamically scaling utterance audio using beamforming parameters, according to embodiments of the present disclosure.

FIG. 10 illustrates an example of a flow for dynamically scaling utterance audio using beamforming parameters, according to embodiments of the present disclosure. In an example, the flow includes operation 1002, where the computer system determines a beamforming traversal angle and a beamforming time. For instance, the computer system receives audio data and beamforming data from a device. The beamforming data indicates the traversal angle and the beamforming time.

In an example, the flow includes operation 1004, where the computer system determines a maximum value, a minimum value, and a slope of each of the noise attenuation factor and the utterance compensation factor. For example, the maximum and minimum values can be determined from a pre-stored curve based on the traversal angle. The slope can be determined based on the maximum and minimum values and the beamforming time (which can correspond to the difference between a start audio frame and end audio frame). For example, a shorter beamforming time may be associated with a steeper slope than a longer beamforming time. A linear noise attenuation factor and a linear utterance compensation factor can be each defined on the respective maximum and minimum values and slope, can be indexed with the audio frame indices, and can be stored in a data store.

In an example, the flow includes operation 1006, where the computer system determines an audio frame index. The audio frame index corresponds to an audio frame of the audio data being processed. The index may be based on a timestamp or frame number associated with an audio frame. For example, if the computer system determines the audio frame includes a timestamp of 0.5 seconds, the computer system can determine the audio frame index is for frame "50."

In an example, the flow includes operation 1008, where the computer system determines applicable values based on the audio frame index. For example, when processing audio frame index "i," the data store is looked up to determine the value of the noise attenuation factor applicable to index "i" and the value of the utterance compensation factor also applicable to index "i."

In an example, the flow includes operation 1010, where the computer system scales the noise signal level and utterance signal level based on the applicable pre-stored values. For example, when processing audio frame "i," the noise signal level is an average noise spectral vector, whereas the utterance signal level is an estimated utterance spectral vector associated with audio frame "i." The computer system can multiply the noise spectral vector by the value of the noise attenuation factor applicable to index "i" to subtract it from the audio spectral vector and can scale up the result by multiplying with value for the utterance compensation factor also applicable to index "i."

In an example, the flow includes operation 1012, where the computer system determines whether there is a next audio frame. If another audio frame exists, the flow returns to operation 1004. Otherwise, the flow proceeds to operation 1014.

In an example, the flow includes operation 1016, where the computer system outputs an estimation of the utterance signal level across multiple frames. For example, the estimation is a set of utterance spectral vectors, each associated with an audio frame index "i."

Figure 11:
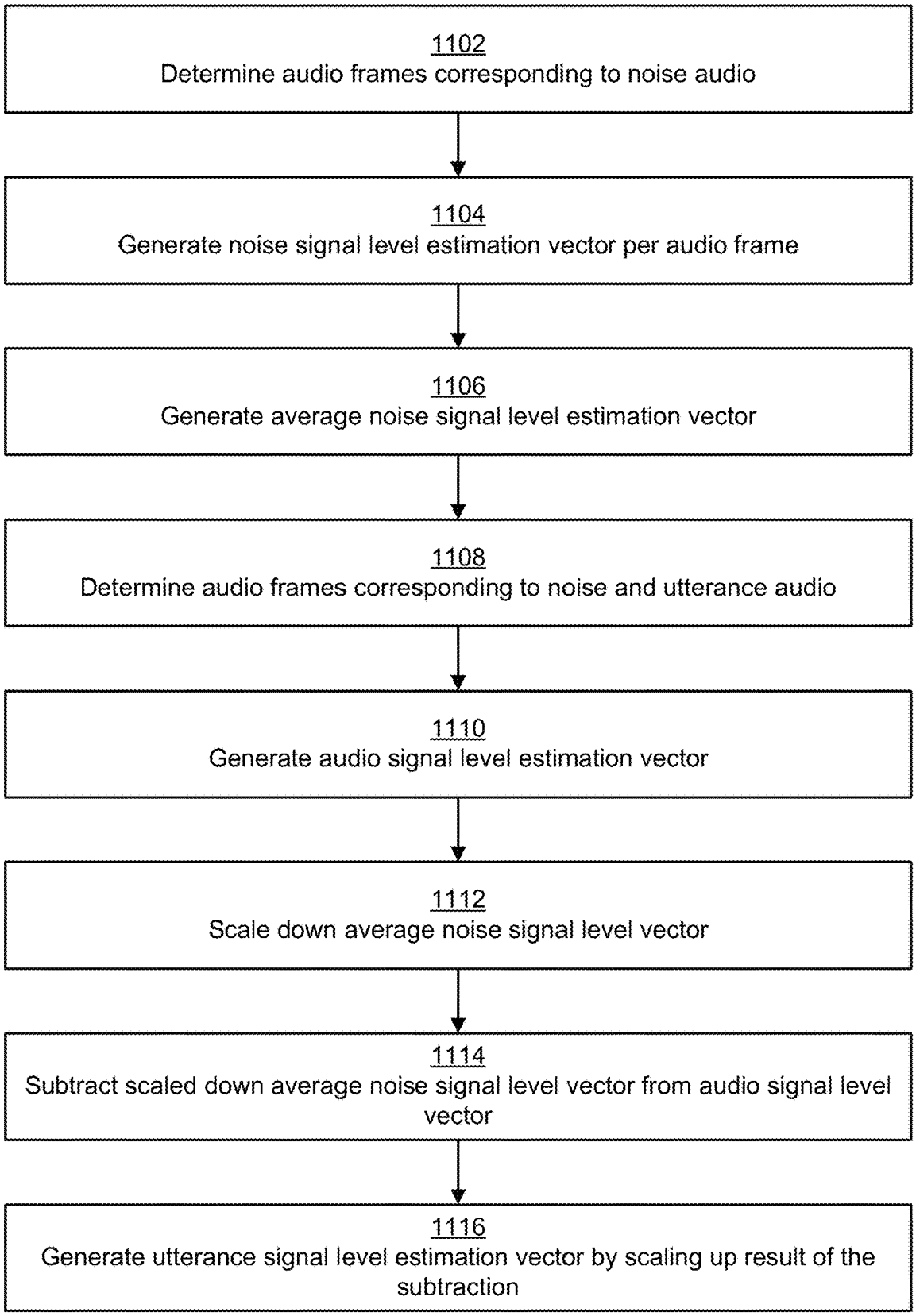
FIG. 11 illustrates an example of a flow for generating an utterance signal vector by scaling an audio signal, according to embodiments of the present disclosure.

FIG. 11 illustrates an example of a flow for generating an utterance signal vector by scaling an audio signal, according to embodiments of the present disclosure. In an example, the flow includes operation 1102, where the computer system determines audio frames corresponding to noise audio. The number of audio frames that correspond to noise audio may be preset (e.g., frames "1" to "50").

In an example, the flow includes operation 1104, where the computer system generates a noise signal level estimation vector per audio frame. The computer system determines the noise signal level over multiple frequency bands (e.g., frequency bands "1" to "32") for each audio frame that corresponds to noise audio to generate the noise signal level estimation vectors.

In an example, the flow includes operation 1106, where the computer system generates an average noise signal level estimation vector. The computer system determines an average noise signal level estimation vector by averaging noise signal level estimation vectors.

In an example, the flow includes operation 1108, where the computer system determines audio frames corresponding to noise and utterance audio. The audio frames that correspond to noise and utterance audio may be preset for a wakeword detection (e.g., frames fifty-one to one hundred twenty-five), or the computer system may receive, from the device, metadata indicating the start and end of the wakeword detection. A subset of these audio frames (e.g., frames "51" to "80") may be associated with an audio beam selection. This subset can be preset or can be determined from metadata also sent by the device.

In an example, the flow includes operation 1110, where the computer system generates an audio signal level estimation vector for each of the audio frames determined at operation 1108. This vector represents the signal level of the noise and utterance audio at the particular frame over the multiple frequency bands.

In an example, the flow includes operation 1112, where the computer system scales down the average noise signal level vector. The computer system multiplies the average noise signal level vector by a noise attenuation factor. The value of the noise attenuation factor may be indexed based on the audio frame.

In an example, the flow includes operation 1114, where the computer system subtracts the scaled down average noise signal level vector from the audio signal level vector. This generates an intermediate estimation of the utterance audio.

In an example, the flow includes operation 1116, where the computer system generates an utterance signal level estimation vector by scaling up a result of the subtraction. The computer system multiplies the result by an utterance compensation factor. The value of the utterance compensation factor may be indexed based on the audio frame.

The overall system of the present disclosure may operate using various components as illustrated in FIG. 12. The various components may be located on same or different physical devices. Communication between various components may occur directly or across a network(s).

An audio capture component(s), such as a microphone or array of microphones of the device 110*a*, captures audio 1211*a*. The device 110*a* processes audio data, representing the audio 1211*a*, to determine whether speech is detected. The audio processing can be performed by a an audio front end 1121*a* that may include an audio beamformer and a beam selector. The device 110*a* may use various techniques to determine whether audio data includes speech. In some examples, the device 110*a* may apply voice activity detection (VAD) techniques. Such techniques may determine whether speech is present in audio data based on various quantitative aspects of the audio data, such as the spectral slope between one or more frames of the audio data; the energy levels of the audio data in one or more spectral bands; the signal-to-noise ratios of the audio data in one or more spectral bands; or other quantitative aspects. In other examples, the device 110*a* may implement a limited classifier configured to distinguish speech from background noise. The classifier may be implemented by techniques such as linear classifiers, support vector machines, and decision trees. In still other examples, the device 110*a* may apply Hidden Markov Model (HMM) or Gaussian Mixture Model (GMM) techniques to compare the audio data to one or more acoustic models in storage, which acoustic models may include models corresponding to speech, noise (e.g., environmental noise or background noise), or silence. Still other techniques may be used to determine whether speech is present in audio data.

Once speech is detected in audio data representing the audio 1211*a*/1211*b*, the devices 110*a*/110*b* may use a wakeword detection component 1220*a*/1220*b* of the audio front end 1221*a*/1221*b* to perform wakeword detection to determine when a user intends to speak an input to the device 110. An example wakeword is "Alexa."

Wakeword detection is typically performed without performing linguistic analysis, textual analysis, or semantic analysis. Instead, the audio data, representing the audio 1211, is analyzed to determine if specific characteristics of the audio data match preconfigured acoustic waveforms, audio signatures, or other data to determine if the audio data "matches" stored audio data corresponding to a wakeword.

Thus, the wakeword detection component 1220 may compare audio data to stored models or data to detect a wakeword. One approach for wakeword detection applies general large vocabulary continuous speech recognition (LVCSR) systems to decode audio signals, with wakeword searching being conducted in the resulting lattices or confusion networks. LVCSR decoding may require relatively high computational resources. Another approach for wakeword detection builds HMIs for each wakeword and non-wakeword speech signals, respectively. The non-wakeword speech includes other spoken words, background noise, etc. There can be one or more HMMs built to model the non-wakeword speech characteristics, which are named filler models. Viterbi decoding is used to search the best path in the decoding graph, and the decoding output is further processed to make the decision on wakeword presence. This approach can be extended to include discriminative information by incorporating a hybrid DNN-HMM decoding framework. In another example, the wakeword detection component 220 may be built on deep neural network (DNN)/recursive neural network (RNN) structures directly, without HMM being involved. Such an architecture may estimate the posteriors of wakewords with context information, either by stacking frames within a context window for DNN, or using RNN.

Follow-on posterior threshold tuning or smoothing is applied for decision making. Other techniques for wakeword detection, such as those known in the art, may also be used.

Once the wakeword is detected, the device 110*a* may "wake" and begin transmitting audio data 112*a*, representing the audio 1211*a*, to the system(s) 130, and the device 110*b* may "wake" and begin transmitting audio data 112*b*, representing the audio 1211*b*, to the system(s) 130. The audio data 112 may include data corresponding to the wakeword, or the device 110 may remove the portion of the audio corresponding to the wakeword prior to sending the audio data 112 to the system(s) 130.

An orchestrator component 1230 may receive the audio data 112. The orchestrator component 1230 may include memory and logic that enables the orchestrator component 1230 to transmit various pieces and forms of data to various components of the system, as well as perform other operations.

The orchestrator component 1230 sends the audio data 112 to an ASR component 1250. The ASR component 1250 transcribes the audio data 112 into text data. The text data output by the ASR component 1250 represents one or more than one (e.g., in the form of an n-best list) ASR hypotheses representing speech represented in the audio data 112. The ASR component 1250 interprets the speech in the audio data 112 based on a similarity between the audio data 112 and pre-established language models. For example, the ASR component 1250 may compare the audio data 112 with models for sounds (e.g., sub-word units, such as phonemes, etc.) and sequences of sounds to identify words that match the sequence of sounds of the speech represented in the audio data 112. The ASR component 1250 outputs text data representing one or more ASR hypotheses. The text data output by the ASR component 1250 may include a top scoring ASR hypothesis or may include an n-best list of ASR hypotheses. Each ASR hypothesis may be associated with a respective score. Each score may indicate a confidence of ASR processing performed to generate the ASR hypothesis with which the score is associated.

The NLU component 1260 attempts to make a semantic interpretation of the phrase(s) or statement(s) represented in the received text data. That is, the NLU component 1260 determines one or more meanings associated with the phrase(s) or statement(s) represented in the text data based on words represented in the text data. The NLU component 1260 determines an intent representing an action that a user desires be performed as well as pieces of the text data that allow a device (e.g., the device 110, the system(s) 130, a skill 1290, a skill system(s) 1225, etc.) to execute the intent. For example, if the text data corresponds to "play Adele music," the NLU component 1260 may determine an intent that the system(s) 130 output music and may identify "Adele" as an artist. For further example, if the text data corresponds to "what is the weather," the NLU component 1260 may determine an intent that the system(s) 130 output weather information associated with a geographic location of the device 110. In another example, if the text data corresponds to "turn off the lights," the NLU component 1260 may determine an intent that the system(s) 130 turn off lights associated with the device(s) 110 or a user(s). The NLU component 1260 may send NLU results data (which may include tagged text data, indicators of intent, etc.).

The system(s) 130 may include one or more skills 1290. A "skill" may be software running on the system(s) 130 that is akin to a software application running on a traditional computing device. That is, a skill 1290 may enable the system(s) 130 to execute specific functionality in order to provide data or produce some other requested output. The system(s) 130 may be configured with more than one skill 1290. For example, a weather service skill may enable the system(s) 130 to provide weather information, a car service skill may enable the system(s) 130 to book a trip with respect to a taxi or ride sharing service, a restaurant skill may enable the system(s) 130 to order a pizza with respect to the restaurant's online ordering system, etc. A skill 1290 may operate in conjunction between the system(s) 130 and other devices, such as the device 110, in order to complete certain functions. Inputs to a skill 1290 may come from speech processing interactions or through other interactions or input sources. A skill 1290 may include hardware, software, firmware, or the like that may be dedicated to a particular skill 1290 or shared among different skills 1290.

In addition or alternatively to being implemented by the system(s) 130, a skill 1290 may be implemented by a skill system(s) 1225. Such may enable a skill system(s) 1225 to execute specific functionality in order to provide data or perform some other action requested by a user.

Skills may be associated with different domains, such as smart home, music, video, flash briefing, shopping, and custom (e.g., skills not associated with any pre-configured domain).

The system(s) 130 may be configured with a single skill 1290 dedicated to interacting with more than one skill system 1225.

Unless expressly stated otherwise, reference to a skill, skill device, skill component, or the like herein may include a skill 1290 operated by the system(s) 130 and/or skill operated by the skill system(s) 1225. Moreover, the functionality described herein as a skill may be referred to using many different terms, such as an action, bot, app, or the like.

The system(s) 130 may include a post-NLU ranker 1265 that receives NLU results data and determines (as described in detail herein) which skill the system(s) 130 should invoke to execute with respect to the user input. The post-NLU ranker 1265 may be implemented separately from the orchestrator component 1230 (as illustrated) or one or more components of the post-NLU ranker 1265 may be implemented as part of the orchestrator component 1230.

The system(s) 130 may include a TTS component 1280. The TTS component 1280 may generate audio data (e.g., synthesized speech) from text data using one or more different methods. Text data input to the TTS component 1280 may come from a skill 1290, the orchestrator component 1230, or another component of the system(s) 130.

In one method of synthesis called unit selection, the TTS component 1280 matches text data against a database of recorded speech. The TTS component 1280 selects matching units of recorded speech and concatenates the units together to form audio data. In another method of synthesis called parametric synthesis, the TTS component 1280 varies parameters such as frequency, volume, and noise to create audio data including an artificial speech waveform. Parametric synthesis uses a computerized voice generator, sometimes called a vocoder.

The system(s) 130 may include profile storage 1270. The profile storage 1270 may include a variety of information related to individual users, groups of users, devices, etc. that interact with the system(s) 130. A "profile" refers to a set of data associated with a user, group of users, device, etc. The data of a profile may include preferences specific to the user, group of users, device, etc.; input and output capabilities of one or more devices; internet connectivity information; user bibliographic information; subscription information; as well as other information.

The profile storage 1270 may include one or more user profiles, with each user profile being associated with a different user identifier. Each user profile may include various user identifying information. Each user profile may also include preferences of the user and/or one or more device identifiers, representing one or more devices registered to the user. Each user profile may include identifiers of skills that the user has enabled. When a user enables a skill, the user is providing the system(s) 130 with permission to allow the skill to execute with respect to the user's inputs. If a user does not enable a skill, the system(s) 130 may not permit the skill to execute with respect to the user's inputs.

The profile storage 1270 may include one or more group profiles. Each group profile may be associated with a different group profile identifier. A group profile may be specific to a group of users. That is, a group profile may be associated with two or more individual user profiles. For example, a group profile may be a household profile that is associated with user profiles associated with multiple users of a single household. A group profile may include preferences shared by all the user profiles associated therewith. Each user profile associated with a group profile may additionally include preferences specific to the user associated therewith. That is, each user profile may include preferences unique from one or more other user profiles associated with the same group profile. A user profile may be a stand-alone profile or may be associated with a group profile. A group profile may include one or more device profiles representing one or more devices associated with the group profile.

The profile storage 1270 may include one or more device profiles. Each device profile may be associated with a different device identifier. Each device profile may include various device identifying information. Each device profile may also include one or more user identifiers, representing one or more user profiles associated with the device profile. For example, a household device's profile may include the user identifiers of users of the household.

Figure 13:
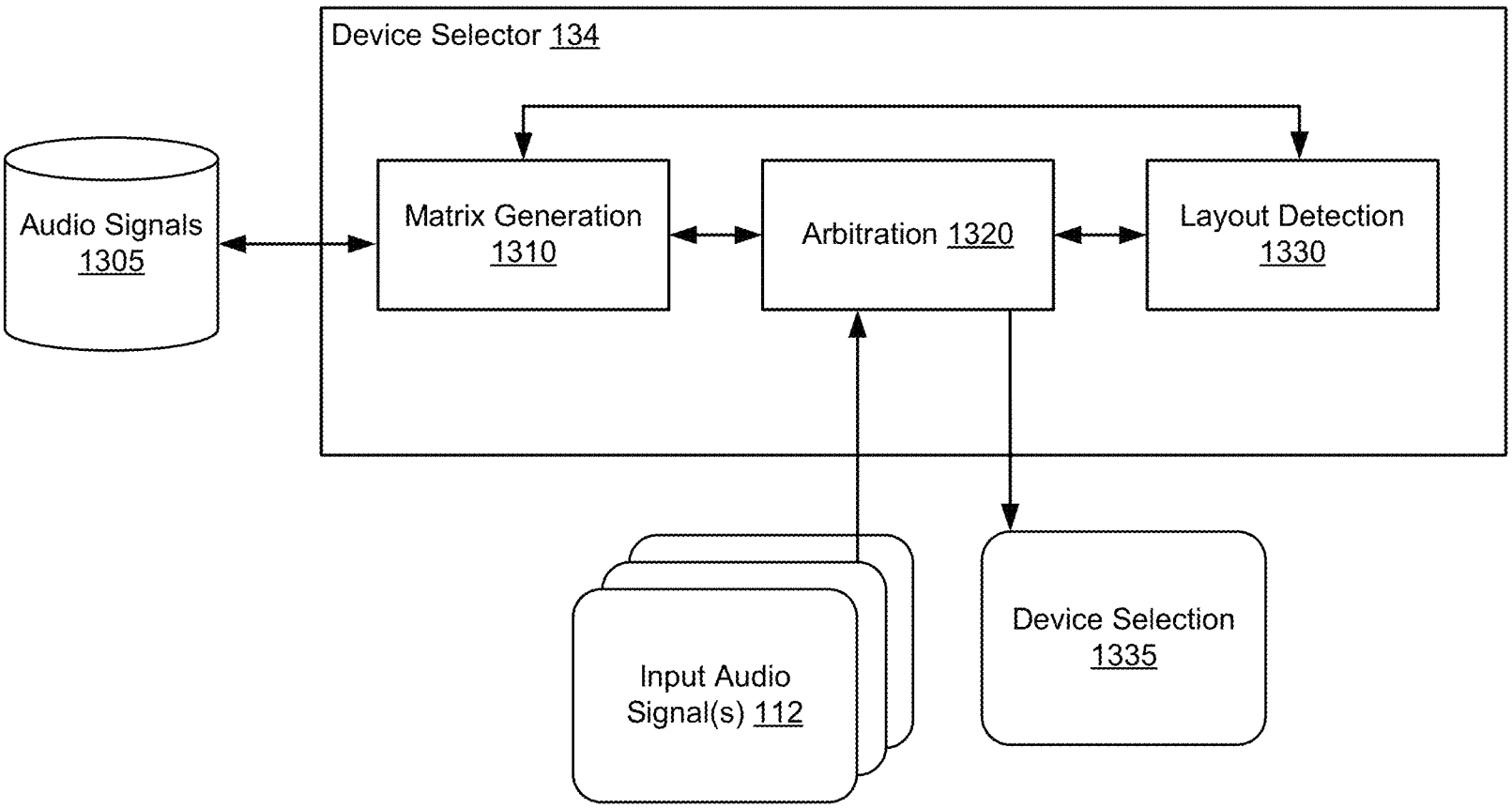
FIG. 13 is a conceptual diagram illustrating components of a device arbitration component according to embodiments of the present disclosure.

The system(s) 130 may include a links action manager component 1295, operations of which are described further in connection with FIG. 13. The links action manager component 1295 may facilitate determining which skills are registered to perform an action, validate payload data received from a skill to determine whether the action can be performed by another skill, and facilitate other functionalities described herein.

The system may be configured to incorporate user permissions and may only perform activities disclosed herein if approved by a user. As such, the systems, devices, components, and techniques described herein would be typically configured to restrict processing where appropriate and only process user information in a manner that ensures compliance with all appropriate laws, regulations, standards, and the like. The system and techniques can be implemented on a geographic basis to ensure compliance with laws in various jurisdictions and entities in which the components of the system and/or user are located.

Various machine learning techniques may be used to train and operate models to perform various steps described herein, such as user recognition feature extraction, encoding, user recognition scoring, user recognition confidence determination, etc. Models may be trained and operated according to various machine learning techniques. Such techniques may include, for example, neural networks (such as deep neural networks and/or recurrent neural networks), inference engines, trained classifiers, etc. Examples of trained classifiers include Support Vector Machines (SVMs), neural networks, decision trees, AdaBoost (short for "Adaptive Boosting") combined with decision trees, and random forests. Focusing on SVM as an example, SVM is a supervised learning model with associated learning algorithms that analyze data and recognize patterns in the data, and which are commonly used for classification and regression analysis. Given a set of training examples, each marked as belonging to one of two categories, an SVM training algorithm builds a model that assigns new examples into one category or the other, making it a non-probabilistic binary linear classifier. More complex SVM models may be built with the training set identifying more than two categories, with the SVM determining which category is most similar to input data. An SVM model may be mapped so that the examples of the separate categories are divided by clear gaps. New examples are then mapped into that same space and predicted to belong to a category based on which side of the gaps they fall on. Classifiers may issue a "score" indicating which category the data most closely matches. The score may provide an indication of how closely the data matches the category.

In order to apply the machine learning techniques, the machine learning processes themselves need to be trained. Training a machine learning component such as, in this case, one of the first or second models, requires establishing a "ground truth" for the training examples. In machine learning, the term "ground truth" refers to the accuracy of a training set's classification for supervised learning techniques. Various techniques may be used to train the models including backpropagation, statistical learning, supervised learning, semi-supervised learning, stochastic learning, or other known techniques.

The ASR 1250, and NLU 1260, Post-NLU ranger 1265 can be implemented as components of the audio processor 132 illustrated in FIG. 1. The system(s) 130 may include a device selector 134 that may be configured to generate a characteristic matrix representing relative locations of multiple devices 110 within a user's household, process audio signals from multiple devices 110 and perform device arbitration to select a device 110 for further processing. In some embodiments, the device 110 may include the device selector 134.

FIG. 13 is a conceptual diagram illustrating components of a device selector 134 that the system 100 may use to perform arbitration according to embodiments of the present disclosure. The device selector 134 may include a matrix generation component 1310, an arbitration component 1320 and a layout detection component 1330.

In some embodiments, the device selector 134 may use stored audio signals 1305 to generate the characteristic matrix as described below. The audio signals 1305 may also be stored in the profile storage 1270, and may represent past utterances spoken by the user. The input audio signals 112 may be received from multiple devices 110 within the user's household and may represent an input utterance spoken by the user. The device selection 1335 may be an indication or data indicating which device the device selector 134 selects for further processing.

The matrix generation component 1310 may generate a characteristic matrix that is used by the arbitration component 1320 to perform device arbitration using the input audio signals 112. The layout detection component 1330 may detect a change in the device layout using information from the arbitration component 1320 and the characteristic matrix, and may send information to the characteristic matrix to update the values in the characteristic matrix.

The matrix generation component 1310 may be configured to determine the characteristic matrix corresponding to a relative location of the devices 110 within the user's household. The matrix generation component 1310 may perform one or more functionalities described below.

Audio propagates through air as a pressure wave. The "volume" or perceived loudness of the wave realized by a device is measured as sound pressure level. As audio waves propagate through air, they lose energy; thus, as the destination/receiving device gets further away from the source, the sound pressure level at the receiving device decreases. Microphones have a "gain" characteristic that is a scalar value/number that when multiplied with sound pressure level measured at the microphone, provides the signal output value from the microphone.

When a user speaks, the sound pressure level of associated audio signal is the strongest as it emanates from the user's mouth. As the audio signal propagates through the air and reflects off of surfaces, the utterance reaches the device 110*a* (D1), for example. The signal (d1) received by device D1 may be calculated as:

$$d1=s\times A1\times G1,$$

where s refers to the sound pressure level, A1 refers to the attenuation of the signal received by device D1, and G1 refers to the microphone gain corresponding to device D1.

Depending on the location of other devices, the device 110*b* (D2) may also receive an audio signal corresponding to the utterance captured by the device 110*a*. The signal (d2) received by device D2 may be calculated as:

$$d2=s\times A2\times G2,$$

where s refers to the sound pressure level, A2 refers to the attenuation of the signal received by device D1, and G2 refers to the microphone gain corresponding to device D2.

In the simplest example, assuming the user is close to D1 when speaking the utterance, the attenuation A1 can be estimated to be 1.0. That is, the signal d1 received by D1 experienced none or negligible energy loss. In this example, then the attenuation A2 represents the acoustic attenuation of the path from the device D1 to the device D2, which may be referred to as the inter-device attenuation corresponding to D1 and D2. Determination of the inter-device attenuation in this example is as follows:

$$d2/d1=(s\times A2\times G2)/(s\times A1\times G1)$$

$$d2/d1=(A2/A1)\times(G2/G1)$$

Since A1 is 1.0 in this example, the above simplifies to:

$$d2/d1=A\times(G2/G1) \qquad \text{Equation 1}$$

The matrix generation component 310 may store the attenuation factor A calculated in the above Equation 1 in a characteristic matrix representing the inter-device attenuation factor from D1 to D2 (e.g., A12).

In some embodiments, the attenuation of the path from the device D2 to the device D1 may be different than the path from the device D1 to the device D2. The system may determine the inter-device attenuation for the path from D1 to D2 (referred to as A12) and may determine the inter-device attenuation for the path from D2 to D1 (referred to as A21). In some embodiments, to determine A21, the system 100 may use an audio signal that originates close to the device D2. That is, the system may use an utterance that the user speaks while close to the device D2, causing the attenuation experienced by D2 to be 1.0 (representing no or negligible energy loss), and resulting in the following calculations:

$$d2/d1=(A2/A1)\times(G2/G1)$$

Since A2 is 1.0 in this example, the above simplifies to:

$$d2/d1=A\times(G2/G1) \qquad \text{Equation 2}$$

The matrix generation component 310 may store the attenuation factor A calculated in the above Equation 2 in a characteristic matrix representing the inter-device attenuation factor from D2 to D1 (e.g., A21).

Thus, the matrix generation component 1310 may generate the following example characteristic matrix for the above example:

Characteristic Matrix 1

| | D1 | D2 |
|---|---|---|
| D1 | 1.0 | A21 |
| D2 | A12 | 1.0 |

As illustrated in the above characteristic matrix, the inter-device attenuation factor between D1 and D1 is set to 1.0. This represents the concept that if an audio signal originates at D1 (e.g., is generated by D1) and heard by D1, then no signal energy loss is experienced by D1, causing the attenuation to be 1.0.

In other embodiments, the attenuation for the path from D1 to D2 may be the same as the attenuation for the path from D2 to D1. That is, A12=A21. In this case, the system may generate the characteristic matrix accordingly.

The following non-limiting example is presented to illustrate how the matrix generation component 1310 may determine the characteristic matrix based on more than two devices. In this example, a user's home may have four devices 110, referred to as D1, D2, D3 and D4. For illustration purposes, assume that the devices are placed in a row, about 20 feet apart, and that received signal energy degrades by 1% per foot. So, a signal energy received at D1 at a level of 100 is received at D2 at a level of 80, is received at D3 at a level of 60, and is received at D4 at a level of 40. Moreover, a signal energy received at D2 at a level of 100 is received by D1 and D3 at a level of 80 (since each is 20 feet apart from D2) and is received by D4 at a level of 60 (since it is 40 feet away from D2).

Using this information, the matrix generation component 1310 may generate the following example characteristic matrix for this example:

Characteristic Matrix 2

| | D1 | D2 | D3 | D4 |
|---|---|---|---|---|
| D1 | 1.0 | 0.8 | 0.6 | 0.4 |
| D2 | 0.8 | 1.0 | 0.8 | 0.6 |
| D3 | 0.6 | 0.8 | 1.0 | 0.8 |
| D4 | 0.4 | 0.6 | 0.8 | 1.0 |

Thus, in some embodiments, the row and column corresponding to a first device (e.g., D1) in the characteristic matrix represents the case when an audio signal is closest to the first device, and includes attenuation factors experienced by the other devices. In other words, when the audio signal is closest to D1, the attenuation factor corresponding to D2 is 0.8, the attenuation factor corresponding to D3 is 0.6, and so on. In some embodiments, the row corresponding to a device may be referred to as an attenuation vector.

Figure 14:
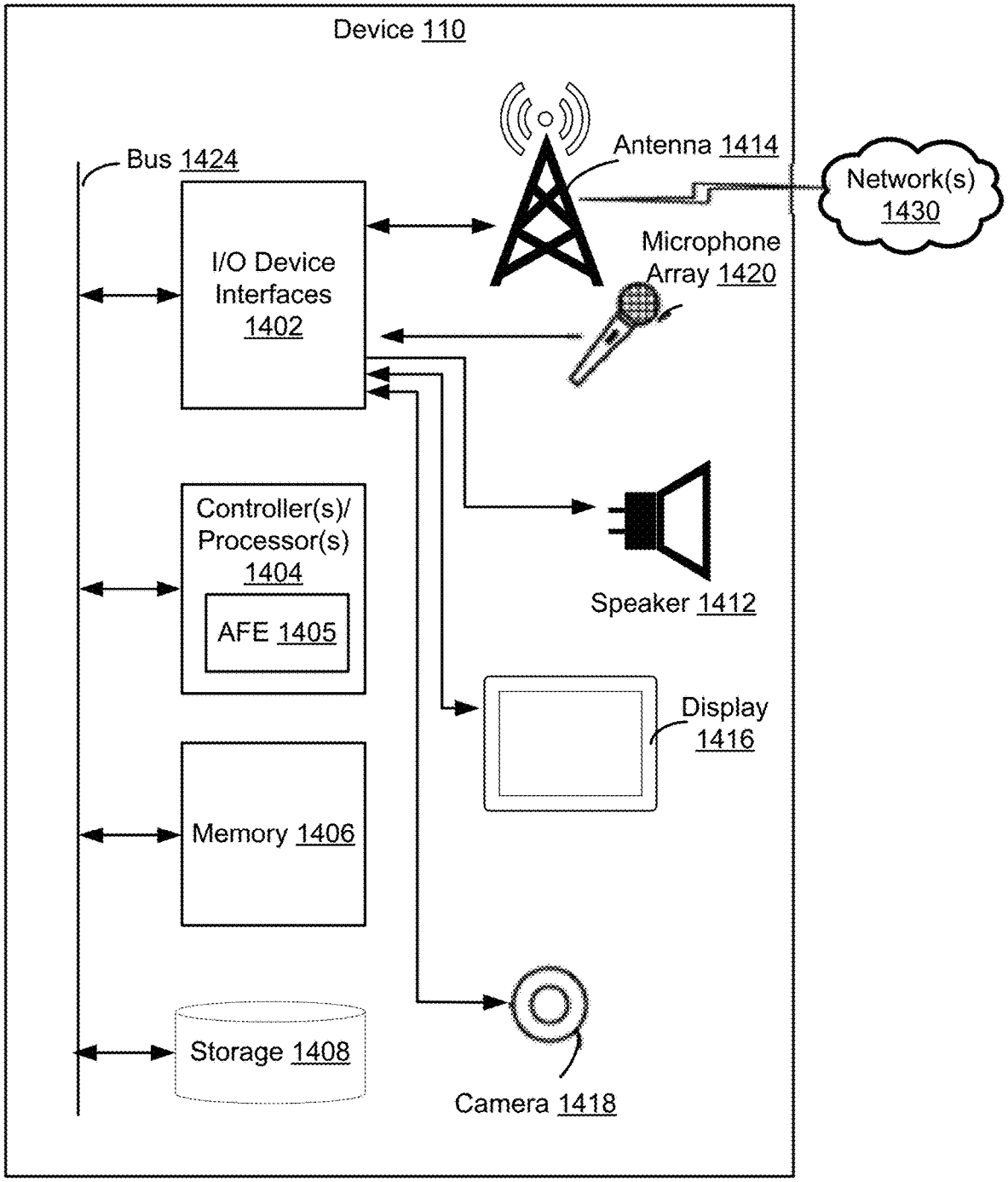
FIG. 14 is a block diagram conceptually illustrating example components of a device according to embodiments of the present disclosure.
Figure 15:
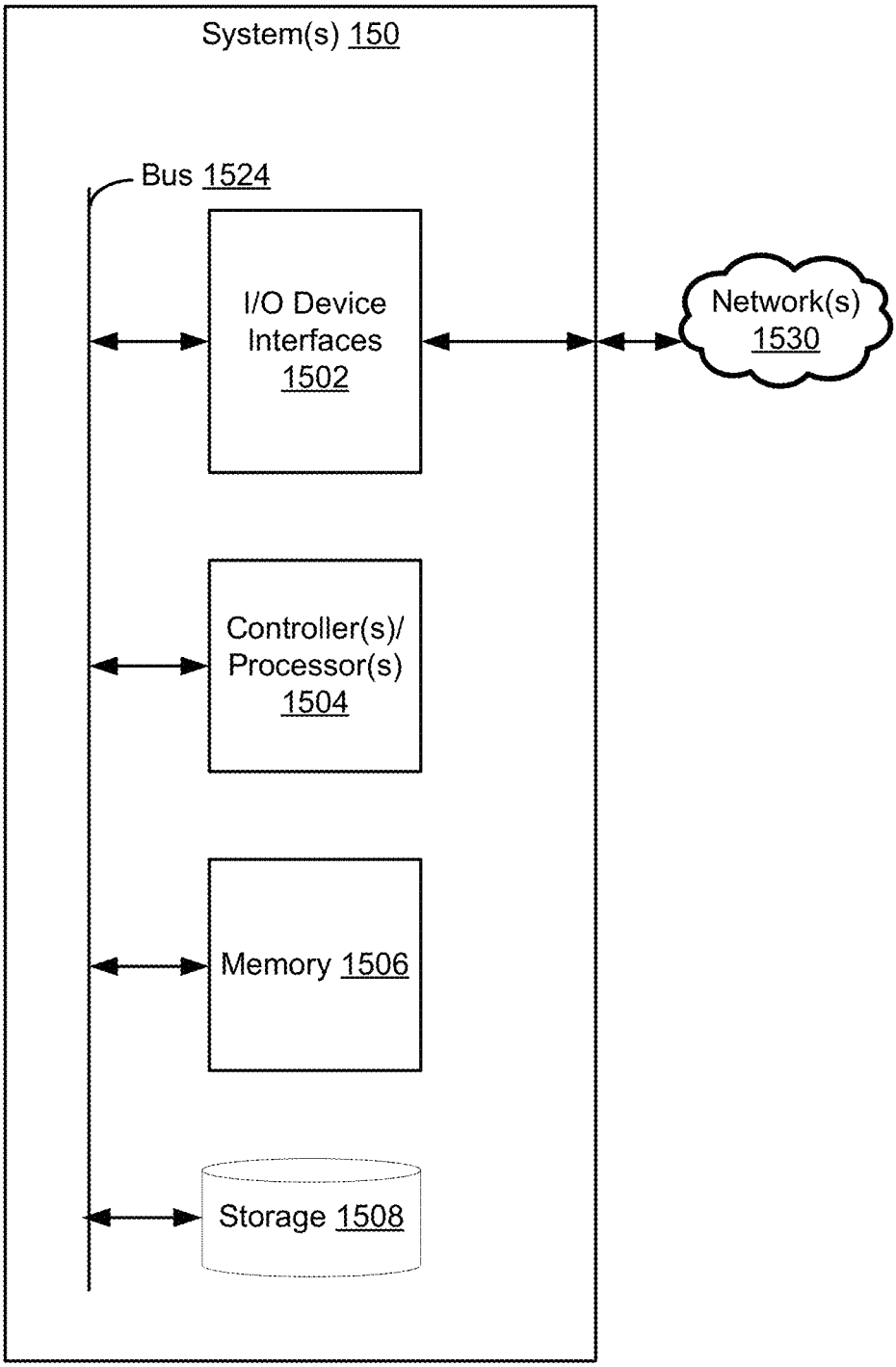
FIG. 15 is a block diagram conceptually illustrating example components of a server according to embodiments of the present disclosure.

FIG. 14 is a block diagram conceptually illustrating a device 110 that may be used with the computer system described herein above. FIG. 15 is a block diagram conceptually illustrating example components of a remote device, such the computer system 130, which may assist with ASR processing, NLU processing, etc., and the skill system(s). A computer system may include one or more servers. A "server" as used herein may refer to a traditional server as understood in a server/client computing structure but may also refer to a number of different computing components that may assist with the operations discussed herein. For example, a server may include one or more physical computing components (such as a rack server) that are connected to other devices/components either physically and/or over a network and is capable of performing computing operations. A server may also include one or more virtual machines that emulates a computer system and is run on one or across multiple devices. A server may also include other combinations of hardware, software, firmware, or the like to perform operations discussed herein. The server(s) may be configured to operate using one or more of a client-server model, a computer bureau model, grid computing techniques, fog computing techniques, mainframe techniques, utility computing techniques, a peer-to-peer model, sandbox techniques, or other computing techniques.

Multiple computer systems may be included in the overall system of the present disclosure, such as one or more systems for performing ASR processing, one or more computer systems for performing NLU processing, one or more skill systems for performing actions responsive to user inputs, etc. In operation, each of these systems may include computer-readable and computer-executable instructions that reside on the respective computer system, as will be discussed further below.

Each of these devices 110 or computer systems 130 may include one or more controllers/processors (1404/1504), which may each include a central processing unit (CPU) for processing data and computer-readable instructions, and a memory (1406/1506) for storing data and instructions of the respective device. The memories (1406/1506) may individually include volatile random access memory (RAM), non-volatile read only memory (ROM), non-volatile magnetoresistive memory (MRAM), and/or other types of memory. Each device or computer system (110/150) may also include a data storage component (1408/1508) for storing data and controller/processor-executable instructions. Each data storage component (1408/1508) may individually include one or more non-volatile storage types such as magnetic storage, optical storage, solid-state storage, etc. Each device or computer system (110/150) may also be connected to removable or external non-volatile memory and/or storage (such as a removable memory card, memory key drive, networked storage, etc.) through respective input/output device interfaces (1402/1502).

Computer instructions for operating each device or computer system (110/150) and its various components may be executed by the respective device's controller(s)/processor(s) (1404/1504), using the memory (1406/1506) as temporary "working" storage at runtime. A device's computer instructions may be stored in a non-transitory manner in non-volatile memory (1406/1506), storage (1408/1508), or an external device(s). Alternatively, some or all of the executable instructions may be embedded in hardware or firmware on the respective device in addition to or instead of software.

Each device or computer system (110/150) includes input/output device interfaces (1402/1502). A variety of components may be connected through the input/output device interfaces (1402/1502), as will be discussed further below. Additionally, each device or computer system (110/150) may include an address/data bus (1424/1524) for conveying data among components of the respective device. Each component within a device or computer system (110/150) may also be directly connected to other components in addition to (or instead of) being connected to other components across the bus (1424/1524).

Referring to FIG. 14, the device 110 may include input/output device interfaces 1402 that connect to a variety of components such as an audio output component such as a speaker 1412, a wired headset or a wireless headset (not illustrated), or other component capable of outputting audio. The device 110 may also include an audio capture component. The audio capture component may be, for example, a microphone array 1420, a wired headset or a wireless headset (not illustrated), etc. If an array of microphones is included, approximate distance to a sound's point of origin may be determined by acoustic localization based on time and amplitude differences between sounds captured by different microphones of the array. The device 110 may additionally include a display 1416 for displaying content. The device 110 may further include a camera 1418.

Via antenna(s) 1414, the input/output device interfaces 1402 may connect to one or more networks 1430 via a wireless local area network (WLAN) (such as WiFi) radio, Bluetooth, and/or wireless network radio, such as a radio capable of communication with a wireless communication network such as a Long Term Evolution (LTE) network, WiMAX network, 3G network, 4G network, 5G network, etc. A wired connection such as Ethernet may also be supported. Through the network(s) 1430, the system may be distributed across a networked environment. The I/O device interface (1402/1202) may also include communication components that allow data to be exchanged between devices such as different physical servers in a collection of servers or other components.

The components of the device(s) 110, the computer system(s) 130, or the skill system(s) may include their own dedicated processors, memory, and/or storage. Alternatively, one or more of the components of the device(s) 110, the computer system(s) 130, or the skill system(s) may utilize the I/O interfaces (1402/1502), processor(s) (1404/1504), memory (1406/1506), and/or storage (1408/1508) of the device(s) 110, the computer system(s) 130, or the skill system(s), respectively. The processor(s) 1404 of the device 110 can include components for an audio front end 1405. Thus, the ASR component may have its own I/O interface(s), processor(s), memory, and/or storage; the NLU component may have its own I/O interface(s), processor(s), memory, and/or storage; and so forth for the various components discussed herein.

As noted above, multiple devices may be employed in a single system. In such a multi-device system, each of the devices may include different components for performing different aspects of the system's processing. The multiple devices may include overlapping components. The components of the device 110, the computer system(s) 130, and the skill system(s), as described herein, are illustrative, and may be located as a stand-alone device or may be included, in whole or in part, as a component of a larger device or system.

The various embodiments further can be implemented in a wide variety of operating environments, which in some cases can include one or more user computers, computing devices or processing devices which can be used to operate any of a number of applications. User or client devices can include any of a number of general purpose personal computers, such as desktop or laptop computers running a standard operating system, as well as cellular, wireless, and handheld devices running mobile software and capable of supporting a number of networking and messaging protocols. Such a system also can include a number of workstations running any of a variety of commercially-available operating systems and other known applications for purposes such as development and database management. These devices also can include other electronic devices, such as dummy terminals, thin-clients, gaming systems, and other devices capable of communicating via a network.

Most embodiments utilize at least one network that would be familiar to those skilled in the art for supporting communications using any of a variety of commercially-available protocols, such as Transmission Control Protocol/Internet Protocol ("TCP/IP"), Open System Interconnection ("OSI"), File Transfer Protocol ("FTP"), Universal Plug and Play ("UpnP"), Network File System ("NFS"), Common Internet File System ("CIFS"), and AppleTalk. The network can be, for example, a local area network, a wide-area network, a virtual private network, the Internet, an intranet, an extranet, a public switched telephone network, an infrared network, a wireless network, and any combination thereof.

In embodiments utilizing a Web server, the Web server can run any of a variety of server or mid-tier applications, including Hypertext Transfer Protocol ("HTTP") servers, FTP servers, Common Gateway Interface ("CGP") servers, data servers, Java servers, and business application servers. The server(s) also may be capable of executing programs or scripts in response to requests from user devices, such as by executing one or more Web applications that may be implemented as one or more scripts or programs written in any programming language, such as Java®, C, C#, or C++, or any scripting language, such as Perl, Python, or TCL, as well as combinations thereof. The server(s) may also include database servers, including without limitation those commercially available from Oracle®, Microsoft®, Sybase®, and IBM®.

The environment can include a variety of data stores and other memory and storage media as discussed above. These can reside in a variety of locations, such as on a storage medium local to (and/or resident in) one or more of the computers or remote from any or all of the computers across the network. In a particular set of embodiments, the information may reside in a storage-area network ("SAN") familiar to those skilled in the art. Similarly, any necessary files for performing the functions attributed to the computers, servers, or other network devices may be stored locally and/or remotely, as appropriate. Where a system includes computerized devices, each such device can include hardware elements that may be electrically coupled via a bus, the elements including, for example, at least one central processing unit ("CPU"), at least one input device (e.g., a mouse, keyboard, controller, touch screen, or keypad), and at least one output device (e.g., a display device, printer, or speaker). Such a system may also include one or more storage devices, such as disk drives, optical storage devices, and solid-state storage devices such as random access memory ("RAM") or read-only memory ("ROM"), as well as removable media devices, memory cards, flash cards, etc.

Such devices also can include a computer-readable storage media reader, a communications device (e.g., a modem, a network card (wireless or wired), an infrared communication device, etc.), and working memory as described above. The computer-readable storage media reader can be connected with, or configured to receive, a computer-readable storage medium, representing remote, local, fixed, and/or removable storage devices as well as storage media for temporarily and/or more permanently containing, storing, transmitting, and retrieving computer-readable information. The system and various devices also typically will include a number of software applications, modules, services, or other elements located within at least one working memory device, including an operating system and application programs, such as a client application or Web browser. It should be appreciated that alternate embodiments may have numerous variations from that described above. For example, customized hardware might also be used and/or particular elements might be implemented in hardware, software (including portable software, such as applets), or both. Further, connection to other computing devices such as network input/output devices may be employed.

Storage media computer readable media for containing code, or portions of code, can include any appropriate media known or used in the art, including storage media and communication media, such as but not limited to volatile and non-volatile, removable and non-removable media implemented in any method or technology for storage and/or transmission of information such as computer readable instructions, data structures, program modules, or other data, including RAM, ROM, Electrically Erasable Programmable Read-Only Memory ("EEPROM"), flash memory or other memory technology, Compact Disc Read-Only Memory ("CD-ROM"), digital versatile disk (DVD), or other optical storage, magnetic cassettes, magnetic tape, magnetic disk storage, or other magnetic storage devices, or any other medium which can be used to store the desired information and which can be accessed by a system device. Based on the disclosure and teachings provided herein, a person of ordinary skill in the art will appreciate other ways and/or methods to implement the various embodiments.

The specification and drawings are, accordingly, to be regarded in an illustrative rather than a restrictive sense. It will, however, be evident that various modifications and changes may be made thereunto without departing from the broader spirit and scope of the disclosure as set forth in the claims.

Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the disclosure to the specific form or forms disclosed, but on the contrary, the intention is to cover all modifications, alternative constructions, and equivalents falling within the spirit and scope of the disclosure, as defined in the appended claims.

The use of the terms "a" and "an" and "the" and similar referents in the context of describing the disclosed embodiments (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the disclosure and does not pose a limitation on the scope of the disclosure unless otherwise claimed. No language in the specification should be construed as indicating any non-claimed element as essential to the practice of the disclosure.

Disjunctive language such as the phrase "at least one of X, Y, or Z," unless specifically stated otherwise, is intended to be understood within the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

Preferred embodiments of this disclosure are described herein, including the best mode known to the inventors for carrying out the disclosure. Variations of those preferred embodiments may become apparent to those of ordinary skill in the art upon reading the foregoing description. The inventors expect skilled artisans to employ such variations as appropriate and the inventors intend for the disclosure to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A system, comprising:

one or more processors; and one or more memory storing computer-readable instruction that, upon execution by the one or more processors, configure the system to:

receive noise data that represents noise received by a device prior to a detection of an utterance;

receive audio data that represents audio received by the device, the audio data generated by the device during a time interval that has a start and an end, the start corresponding to a beginning of the utterance, the end corresponding to at a selection by the device of an audio beam associated with a direction towards an utterance source;

generate, by at least performing first Fast Fourier Transform (FFT) operations on the noise data, first spectral measurement data that indicates an average amplitude of the noise;

determine a first value that is associated with a noise attenuation factor and with a time point of the time interval, the noise attenuation factor linearly increasing during the time interval between a first minimum value at the start of the time interval and a first maximum value at the end of the time interval;

generate an attenuated amplitude of the noise by multiplying the average amplitude by the first value, the attenuated amplitude associated with the time point;

generate, by at least performing second FFT operations on the audio data, second spectral measurement data that indicates second values of an amplitude of the audio during the time interval, the second values comprising a second value associated with the time point;

generate an adjusted value of the amplitude of the audio by subtracting the attenuated amplitude from the second value, the adjusted value associated with the time point;

determine a third value that is associated with an utterance compensation factor and with the time point, the utterance compensation factor linearly decreasing during the time interval between a second maximum value at the start of the time interval and a second minimum value at the end of the time interval;

generate fourth spectral measurement data that indicates fourth values of an amplitude of the utterance during the time interval, the fourth values comprising a fourth value that is associated with the time point, the fourth value determined by multiplying the adjusted value by the third value; and determine, based at least in part on the fourth spectral measurement data, that additional audio data associated with the device is to be processed.

2. The system of claim 1, wherein the first maximum value is equal to the second maximum value, wherein the first minimum value is equal to the second minimum value, and wherein the noise attenuation factor is an inverse of the utterance compensation factor.

3. The system of claim 1, wherein the one or more memory store additional computer-readable instruction that, upon execution by the one or more processors, configure the system to:

receive additional audio data that represents additional audio detected by the device, the additional audio data generated by the device during another time interval that begins at the selection of the audio beam; and generate, based at least in part on the additional audio data, the noise attenuation factor, and the utterance compensation factor, fifth spectral measurement data that indicates fifth values of the amplitude of the utterance during the other time interval, wherein the noise attenuation factor is constant during the other time interval, and wherein the utterance compensation factor is constant during the other time interval.

4. A computer-implemented method, comprising:

receiving audio data representing noise and utterance received by a device during a first time interval that has a start and an end, the start corresponding to a beginning of the utterance, the end corresponding to at a selection by the device of an audio beam associated with a direction towards an utterance source;

determining values that represent an audio adjustment factor and that vary during the first time interval, the values comprising a first value associated with a first time point of the first time interval and a second value associated with a second time point of the first time interval; and generating, based at least in part on the audio data, the first value, and the second value, first data that indicates a measurement of at least one of the noise or the utterance.

5. The computer-implemented method of claim 4, wherein the audio data, the noise, and the audio adjustment factor are first audio data, first noise, and an utterance compensation factor, respectively, and wherein the computer-implemented method further comprises:

receiving second audio data that represents second noise received by the device during a second time interval that precedes the first time interval, the second time interval ending at the start of the first time interval;

generating, based at least in part on the first audio data, first measurement data that indicates an amplitude of audio that includes the first noise and the utterance;

generating, based at least in part on the second audio data, second measurement data that indicates an average amplitude of the second noise;

generating, based at least in part on the first measurement data and the second measurement data, third measurement data that indicates an amplitude of the utterance; and determining, based at least in part on the third measurement data and the utterance compensation factor, an adjusted amplitude of the utterance.

6. The computer-implemented method of claim 4, wherein the audio data, the noise, and the audio adjustment factor are first audio data, first noise, and a noise attenuation factor, respectively, and wherein the computer-implemented method further comprises:

receiving second audio data that represents second noise received by the device during a second time interval that precedes the first time interval, the second time interval ending at the start of the first time interval;

generating, based at least in part on the second audio data, first measurement data that indicates an average amplitude of the second noise;

determining, based at least in part on the noise attenuation factor and the average amplitude, an attenuated amplitude of the second noise, wherein the attenuated amplitude varies during the first time interval; and generating, based at least in part on the first audio data and the attenuated amplitude, second measurement data that indicates an amplitude of the utterance.

7. The computer-implemented method of claim 4, wherein the audio adjustment factor comprises an utterance compensation factor, wherein the first value is a value of the utterance compensation factor, and wherein the computer-implemented method further comprises:

determining an index associated with the audio data; and determining, from a data store, the first value based at least in part on the index, wherein the utterance compensation factor decreases from a first maximum value associated with the start of the first time interval to a first minimum value associated with the end of the first time interval.

8. The computer-implemented method of claim 7, wherein the audio adjustment factor further comprises a noise attenuation factor, wherein the second value is a value of the noise attenuation factor, and wherein the computer-implemented method further comprises:

determining, from the data store, the second value based at least in part on the index, wherein the noise attenuation factor increases from a second minimum value associated with the start of the first time interval to a second maximum value associated with the end of the first time interval.

9. The computer-implemented method of claim 4, further comprising:

determining a beamforming parameter associated with the audio data, wherein the beamforming parameter comprises at least one of: a traversal angle or the first time interval, and wherein the values are determined based at least in part on the beamforming parameter.

10. The computer-implemented method of claim 4, wherein the audio adjustment factor comprises an utterance compensation factor, and wherein the computer-implemented method further comprises:

determining a beamforming parameter that comprises at least one of: a traversal angle or the first time interval;

determining, based at least in part on the beamforming parameter, a first maximum value and a first minimum value of the utterance compensation factor, wherein the first maximum value is associated with the start of the first time interval, and wherein the first minimum value is associated with the end of the first time interval;

determining an index associated with the audio data; and determining the first value based at least in part on the first maximum value, the first minimum value, and the index.

11. The computer-implemented method of claim 10, wherein the audio adjustment factor further comprises a noise attenuation factor, and wherein the computer-implemented method further comprises:

determining, based at least in part on the beamforming parameter, a second minimum value and a second maximum value of the noise attenuation factor, wherein the second minimum value is associated with the start of the time first interval, and wherein the second maximum value is associated with the end of the first time interval; and determining the second value based at least in part on the second minimum value, the second maximum value, and the index.

12. A system comprising:

one or more processors; and one or more memory storing computer-readable instruction that, upon execution by the one or more processors, configure the system to:

receive audio data representing noise and utterance received by a device during a first time interval that has a start and an end, the start corresponding to a beginning of the utterance, the end corresponding to at a selection by the device of an audio beam associated with a direction towards an utterance source;

determine values that represent an audio adjustment factor and that vary during the first time interval, the values comprising a first value associated with a first time point of the first time interval and a second value associated with a second time point of the first time interval; and generate, based at least in part on the audio data, the first value, and the second value, first data that indicates a measurement of at least one of the noise or the utterance.

13. The system of claim 12, wherein the noise and the audio adjustment factor are first noise and noise attenuation factor, respectively, and wherein the one or more memory further store additional computer-readable instruction that, upon execution by the one or more processors, configure the system to:

receive second audio data that represents second noise receives by the device prior to the first time interval;

generate, based at least in part on the second audio data, first measurement data that indicates a signal level of the second noise; and generate, based at least in part on the first measurement data and the noise attenuation factor, second measurement data that indicates an attenuated signal level of the first noise.

14. The system of claim 12, wherein the first data indicates a spectral vector of elements, wherein each element corresponds to a frequency band and indicates an average audio amplitude at the frequency band, and wherein the values of the elements are multiplied by a value of the audio adjustment factor.

15. The system of claim 12, wherein the first value that is associated with a first frequency band, wherein the first data indicates a spectral vector that includes a first element associated with the first frequency band and a second element associated with a second frequency band, wherein the first element is multiplied by the first value and the second element is multiplied by the second value of the audio adjustment factor, and wherein the second value is associated with the second frequency band.

16. The system of claim 12, wherein the noise and the audio adjustment factor are first noise and a noise attenuation factor, respectively, and wherein the one or more memory further store additional computer-readable instruction that, upon execution by the one or more processors, configure the system to:

determine second audio data that represents second noise received by the device prior to the first time interval;

generate, based at least in part on the second audio data, second data that indicates a signal level of the second noise; and generate, based at least in part on the first data and the noise attenuation factor, the first data that indicates a signal level of the utterance.

17. The system of claim 16, wherein the second data comprises a first spectral vector, wherein the first spectral vector is multiplied by the noise attenuation factor.

18. The system of claim 16, wherein the first audio adjustment factor further comprises an utterance compensation factor, wherein the first data comprises a second spectral vector, wherein the second spectral vector is multiplied by the utterance compensation factor.

19. The system of claim 12, wherein the values are determined based at least in part on a length of the first time interval.

20. The system of claim 12, wherein a difference between the second value and the first value corresponds to a linear change to the audio adjustment factor during the first time interval.

* * * * *